US007019475B2

(12) United States Patent
Nireki

(10) Patent No.: US 7,019,475 B2
(45) Date of Patent: Mar. 28, 2006

(54) MOTOR STOP CONTROL DEVICE FOR GAMING MACHINE AND GAMING MACHINE PROVIDED WITH THE MOTOR STOP CONTROL DEVICE

(75) Inventor: Takao Nireki, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 10/902,378

(22) Filed: Jul. 30, 2004

(65) Prior Publication Data

US 2005/0029977 A1 Feb. 10, 2005

(30) Foreign Application Priority Data

Aug. 5, 2003 (JP) ..... 2003-286906

(51) Int. Cl.
*A63F 7/02* (2006.01)

(52) U.S. Cl. ..... 318/272; 318/696; 463/20; 273/143 R

(58) Field of Classification Search ..... 318/268, 318/272, 269, 685, 696; 273/143 R, 148 R; 463/16–21
See application file for complete search history.

(56) References Cited

U.S. PATENT DOCUMENTS 3,690,657 A * 9/1972 Nakamura ..... 273/242
4,518,098 A * 5/1985 Fleischer ..... 221/15
4,697,129 A 9/1987 Enami et al.
5,018,737 A * 5/1991 Okada ..... 273/143 R
5,024,439 A * 6/1991 Okada ..... 273/143 R
5,609,524 A 3/1997 Inoue
6,857,338 B1 * 2/2005 Tsergas ..... 74/606 R
6,880,826 B1 * 4/2005 Inoue ..... 273/143 R
2002/0180147 A1 12/2002 Inoue

FOREIGN PATENT DOCUMENTS

EP 0 414 428 A2 2/1991
EP 0 414 428 A3 2/1991
JP 09-266979 10/1997
JP 09-327553 12/1997
JP 10-071240 3/1998

* cited by examiner

*Primary Examiner*—Bentsu Ro
(74) *Attorney, Agent, or Firm*—Snider & Associates; Ronald R. Snider

(57) ABSTRACT

The present invention can accurately stop a reel at a target position and, at the same time, can offer a wide variety of reel stop process. A motor stop control device includes a stepping motor 70 having two pair of excitation phases as a drive source of a reel which is stopped in response to a manipulation command from the outside and displays a plurality of symbols. The motor stop control device further includes a speed reduction transmission mechanism 700 which transmits the rotation of the stepping motor 70 to a rotary shaft which rotates the reel 3 at a predetermined speed reduction ratio, and a main CPU 40 which, when a command for stopping the stepping motor 70 is generated in response to the command from the outside, selects either one of reel stop control processing 1 which executes a stop control based on all-phase excitation with respect to the stepping motor 70 and reel stop control processing 2 which executes a control to reduce a rotational speed of the stepping motor 70 and, thereafter, executes the stop control based on two-phase excitation with respect to the stepping motor 70.

4 Claims, 16 Drawing Sheets

Fig.7

<SELECTION TABLE 1>

| NUMBER OF SLID FRAMES | REEL STOP CONTROL PROCESSING |
|---|---|
| 0 | REEL STOP CONTROL PROCESSING 2 |
| 1 | REEL STOP CONTROL PROCESSING 2 |
| 2 | REEL STOP CONTROL PROCESSING 2 |
| 3 | REEL STOP CONTROL PROCESSING 2 |
| 4 | REEL STOP CONTROL PROCESSING 1 |

Fig.8

<SELECTION TABLE 2>

| INTERNAL PRIZE NUMBER | REEL STOP CONTROL PROCESSING |
|---|---|
| WATERMELON | REEL STOP CONTROL PROCESSING 1 |
| BELL | REEL STOP CONTROL PROCESSING 1 |
| CORNER CHERRY | REEL STOP CONTROL PROCESSING 1 |
| CENTER CHERRY | REEL STOP CONTROL PROCESSING 1 |
| REPLAY | REEL STOP CONTROL PROCESSING 1 |
| RB(REGULAR BONUS) | REEL STOP CONTROL PROCESSING 1 |
| BB(BIG BONUS) | REEL STOP CONTROL PROCESSING 1 |
| BLANK | REEL STOP CONTROL PROCESSING 2 |

Fig.9

≪REEL STOP CONTROL PROCESSING≫

| | STOP PROCESSING | | ENERGIZING PROCESSING |
|---|---|---|---|
| | SYMBOL PROCESSING | SPEED REDUCTION PROCESSING | |
| REEL STOP CONTROL PROCESSING 1 | ○ | × | ALL-PHASE ON |
| REEL STOP CONTROL PROCESSING 2 | ○ | ○ | TWO-PHASE ON |

MOTOR STOP CONTROL DEVICE FOR GAMING MACHINE AND GAMING MACHINE PROVIDED WITH THE MOTOR STOP CONTROL DEVICE

CROSS-REFERENCES TO THE RELATED APPLICATIONS

This application is based upon and claims the priority from a prior Japanese patent applications No. 2003-286906, filed on Aug. 5, 2003, in Japan, entire contents of which are incorporated herein by reference.

BACKGROUND OF THE INVENTION

1. Field of the Invention

The present invention relates to a motor stop control device for a gaming machine and a gaming machine provided with the motor stop control device.

2. Related Art

Conventionally, in a symbol changing device for a gaming machine (for example, a slot machine), a rotary shaft of a stepping motor is directly inserted in a center opening of a reel (a direct-drive system) (for example, see Japanese Laid-open Patent Publication Hei10(1998)-71240). Such a direct-drive system adopts the structure in which a rotational torque of the stepping motor is directly transmitted to a rotary shaft of the reel and hence, the structure around the stepping motor is simplified.

SUMMARY OF THE INVENTION

With respect to the control of the reel adopting the above-mentioned direct-drive system, a method which executes a stop control of the stepping motor based on all-phase excitation and utilizes a detent torque of a stepping motor has been popularly used. However, this detent torque is varied for every reel and inertia (moment of inertia) of the reel is also varied for every reel. Accordingly, the stop position of the symbol becomes unstable and hence, it is difficult to accurately stop the symbol which is displayed on a surface of the reel accurately.

Further, to suppress the generation of irregularities with respect to the above-mentioned stop position of the symbol, an operator is required to perform an operation to reduce the irregularities of the detent torque of the stepping motor and the operation to adjust the balance between the detent torque and the inertia of the reel on a site (the balance adjustment). In this case, there has been a drawback that the number of man-hours for assembling the reel unit is increased.

On the other hand, there has been also known a gear mechanism system which can reduce the inertia of a reel by disposing a gear which transmits the rotation of a stepping motor to the reel between a drive shaft of the stepping motor and a rotary shaft of the reel. According to this gear mechanism system, since the inertia of the reel can be reduced, it is possible to accurately stop the reel at a target position and, at the same time, the above-mentioned balance adjustment becomes no more necessary and hence, the number of man-hours can be reduced in assembling the reel unit.

Further, in addition to this gear mechanism system, there has been also known a speed reduction profile method which stops a reel by decreasing a fixed rotational speed to a predetermined rotational speed. According to this speed reduction profile method, since processing which reduces the speed from the fixed rotational speed to the predetermined rotational speed is executed, it is possible to stop the reel at a target position more accurately. As a result, by adopting either one of the gear mechanism system or the speed reduction profile system, it is possible to overcome the above-mentioned drawbacks attributed to the direct drive system.

However, when either one of the gear mechanism system or the speed reduction profile system is used in a fixed manner, the stop process from a point of time that the reel is rotated at a fixed speed to a point of time that the reel is completely stopped becomes monotonous and hence, a player becomes readily bored.

Accordingly, there has been a strong demand for the development of a motor stop control device which can accurately stop the reel at the target position by selecting either one of the gear mechanism system and the speed reduction profile system and, at the same time, can offer a wide variety of reel stop process.

The present invention has been made under such circumstances and it is an object of the present invention to provide a motor stop control device which can accurately stop a reel at a target position and, at the same time, can offer a wide variety of reel stop process.

To achieve the above-mentioned object, the present invention provides a motor stop control device for a gaming machine which includes a motor which constitutes a drive source of a reel which is stopped in response to a manipulation command and displays a plurality of symbols, a speed reduction transmission mechanism which transmits the rotation of the motor to a rotary shaft, the rotary shaft rotating the reel at a predetermined speed reduction ratio, and a motor stop control means which, when a command for stopping the motor is generated in response to the command, selects either one of first processing which executes a stop control with respect to the motor and second processing which executes a control to reduce a rotational speed of the motor and executes the stop control with respect to the motor.

According to the present invention having such a constitution, when the speed reduction transmission mechanism transmits the rotation of the motor to the rotary shaft which rotates the reel at the predetermined speed reduction ratio and the command for stopping the motor is generated in response to the command from the outside, the motor stop control means selects either one of the first processing which executes the stop control with respect to the motor and the second processing which executes the control to reduce the rotational speed of the motor and executes the stop control with respect to the motor and hence, the motor stop control device can accurately stop the reel and, at the same time, can offer a wide variety of reel stop process from a point of time that the reel is rotated at a fixed rotational speed to a point of time that the reel is completely stopped. Here, the stop processing is not limited to the stop operation performed by pushing the stop buttons. It may include a stop control of the reels based on a program stored in the main circuit. For example, the reel may be stopped after a lapse of a predetermined time using a timer.

Further, since the speed reduction transmission mechanism transmits the rotation of the motor to the rotary shaft which rotates the reel at the predetermined speed reduction ratio, the motor stop control device can suppress a stop error attributed to a detent torque generated at the time of stopping the reel to a low value. That is, when the speed reduction ratio is 1:7, the motor stop control device can suppress the degree of influence attributed to the detent torque to one seventh and can suppress the stop error attributed to the detent torque at the time of stopping the reel to a low value correspondingly.

Further, when the motor stop control means selects the second processing in which the motor stop control means executes the control to reduce the rotational speed of the motor and executes the stop control with respect to the motor, the motor stop control device can readily attenuate the vibration of the reel which is generated at the time of stopping the reel.

Further, in the above-mentioned motor stop control device for a gaming machine, the motor stop control device uses the motor having two pairs of excitation phases as the drive source of the reel, and the first processing executes the stop control based on all-phase excitation with respect to the motor and the second processing which executes the stop control based on two-phase excitation with respect to the motor.

Due to such a constitution, when the motor stop control means selects the second processing in which the motor stop control means executes the control to reduce the rotational speed of the motor and executes the stop control based on the two-phase excitation with respect to the motor, the motor stop control device can readily attenuate the vibration of the reel which is generated at the time of stopping the reel.

To achieve the above-mentioned object, the present invention provides a gaming machine provided with a motor stop control device, wherein the motor stop control device includes a motor which constitutes a drive source of a reel which is stopped in response to a manipulation command and displays a plurality of symbols, a speed reduction transmission mechanism (for example, a speed reduction mechanism 700) which transmits the rotation of the motor to a rotary shaft, the rotary shaft rotating the reel at a predetermined speed reduction ratio, and a motor stop control means which, when a command for stopping the motor is generated in response to the command, selects either one of first processing (for example, reel stop control processing 1) which executes a stop control with respect to the motor and second processing (for example, reel stop control processing 2) which executes a control to reduce a rotational speed of the motor and executes the stop control with respect to the motor.

According to the present invention having such a constitution, when the speed reduction transmission mechanism transmits the rotation of the motor to the rotary shaft which rotates the reel at the predetermined speed reduction ratio and the command for stopping the motor is generated in response to the command from the outside, the motor stop control means selects either one of the first processing which executes the stop control with respect to the motor and the second processing which executes the control to reduce the rotational speed of the motor and executes the stop control with respect to the motor and hence, the motor stop control device can accurately stop the reel at the target position and, at the same time, can offer a wide variety of reel stop process from a point of time that the reel is rotated at a fixed speed to a point of time that the reel is completely stopped. Here, the stop processing is not limited to the stop operation performed by pushing the stop buttons. It may include a stop control of the reels based on a program stored in the main circuit. For example, the reel may be stopped after a lapse of a predetermined time using a timer.

Further, since the speed reduction transmission mechanism transmits the rotation of the motor to the rotary shaft which rotates the reel at the predetermined speed reduction ratio, the motor stop control device can suppress a stop error attributed to a detent torque generated at the time of stopping the reel to a low value. That is, when the speed reduction ratio is 1:7, the motor stop control device can suppress the degree of influence attributed to the detent torque to one seventh and can suppress the stop error attributed to the detent torque at the time of stopping the reel to a low value correspondingly.

Further, when the motor stop control means selects the second processing in which the motor stop control means executes the control to reduce the rotational speed of the motor and executes the stop control with respect to the motor, the motor stop control device can readily attenuate the vibration of the reel which is generated at the time of stopping the reel.

Further, in the above-mentioned gaming machine, the motor stop control device uses the motor having two pair of excitation phases as the drive source of the reel, and the first processing executes a stop control based on all-phase excitation with respect to the motor and the second processing which executes the stop control based on two-phase excitation with respect to the motor.

Due to such a constitution, when the motor stop control means selects the second processing in which the motor stop control means executes the control to reduce the rotational speed of the motor and executes the stop control based on the two-phase excitation with respect to the motor, the motor stop control device can readily attenuate the vibration of the reel which is generated at the time of stopping the reel.

In the above-mentioned inventions, it is desirable that the motor stop control means selects the above-mentioned first processing when a traveling of the symbols displayed on the reel (for example, the number of slid frames) which is determined by traveling decision means (for example, a main CPU) does not fall within a predetermined range of number of the symbols at the time of generation of a command to stop the motor, and selects the above-mentioned second processing when the traveling determined by the traveling decision means falls within a predetermined range of number of symbols.

In this case, since the motor stop control means selects the first processing when the traveling decided by the traveling decision means does not fall within the preliminarily set predetermined range of number of symbols, and selects the second processing when the traveling decided by the traveling decision means falls within a preliminarily set predetermined range of number of symbols, the motor stop control device can complete the stop processing of the reel within the time which satisfies regulations and, at the same time, can accurately stop the reel at the target position.

That is, when the second processing is selected in a state that the traveling exceeds the number of preliminarily set predetermined symbols, since the second processing includes the processing which reduces the rotational speed of the reel (speed reduction processing), there may be a case that the reel stop processing is not finished within the time which satisfies the regulations. Accordingly, by allowing the motor stop control means to select the first processing which does not include the speed reduction processing when the traveling exceeds the number of preliminarily set predetermined symbols and to select the second processing which includes the speed reduction processing when the traveling does not exceed the number of preliminarily set predetermined symbols, the motor stop control device can complete the reel stop processing within the time which satisfies the regulations and, at the same time, can accurately stop the reel at the target position.

Further, since the first processing is selected when the traveling exceeds the number of preliminarily set predetermined symbols, it appears to a player that the symbol is gently and slowly stopped. On the other hand, since the second processing is selected when the traveling does not exceed the number of preliminarily set predetermined symbols, it appears to a player that the symbol is quickly stopped. Accordingly, the motor stop control device can offer a wide variety of reel stop process from a point of time that the reel is rotated at a fixed speed to a point of time that the reel is completely stopped and hence, the motor stop control device can further enhance the fun or the interest of the game.

In the above-mentioned inventions, it is preferable that the gaming machine further includes a winning combination determination means for determining a winning combination, wherein the motor stop control means selects either one of the first processing and the second processing corresponding to the winning combination.

In this case, by allowing the motor stop control means to select either one of the first processing and the second processing corresponding to the winning combination which is decided by the winning combination decision means, the motor stop control device can offer a wider variety of reel stop process.

Here, the motor stop control means may select the third processing or the fourth processing. The third processing executes the control to reduce the rotational speed of the motor until a predetermined time passes from a point of time that the command for stopping the motor is generated in response to the command from the outside and executes the stop control based on two-phase excitation with respect to the motor. The fourth processing executes the control to reduce the rotational speed of the motor until a time shorter than the predetermined time passes from the point of time that the command for stopping the motor is generated in response to the command from the outside and the stop control based on two-phase excitation with respect to the motor.

As has been described above, according to the present invention, it is possible to accurately position the reel at the target position and, at the same time, can offer a wider variety of reel stop process.

BRIEF DESCRIPTION OF THE DRAWINGS

FIG. 7 is a view showing a selection table 1 of this embodiment;

FIG. 8 is a view showing a selection table 2 of this embodiment;

FIG. 9 is a view showing reel stop control processing of this embodiment;

DESCRIPTION OF THE PREFERRED EMBODIMENTS (Basic Constitution of Motor Stop Control Device)

Figure 1:
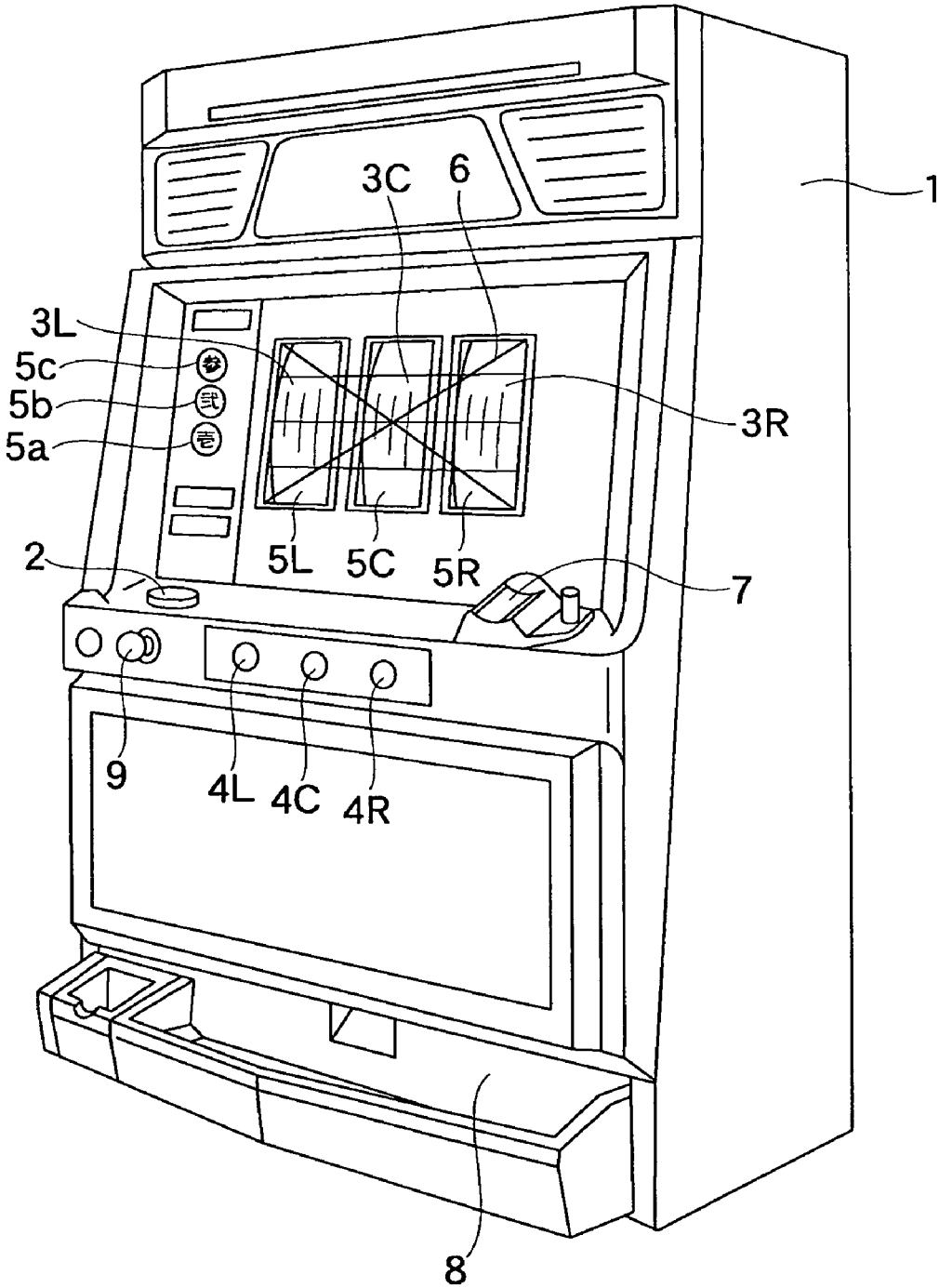
FIG. 1 is a front view showing a front face of a game machine according to this embodiment.

A motor stop control device of this embodiment is explained hereinafter in conjunction with drawings. FIG. 1 is an appearance view of a gaming machine 1 of this embodiment.

As shown in FIG. 1, on a front face of a cabinet which constitutes the whole gaming machine 1, three panel display windows 5L, 5C, 5R are formed. Reels 3L, 3C, 3R which form a reel unit are observed with naked eyes through these panel display windows 5L, 5C, 5R. Further, on these panel display windows 5L, 5C, 5R, three pay lines 6 which extend in the lateral direction and two pay lines 6 which extend in the oblique direction are described, and the number of pay lines 6 which become effective corresponding to the number of coins inserted from an insertion opening 7 is decided.

When a player inserts coins in the insertion opening 7 and manipulates a start lever 9, the rotations of respective reels 3L, 3C, 3R are started. Then, when the player pushes down stop buttons 4L, 4C, 4R which are provided corresponding to the respective reels 3L, 3C, 3R, the rotations of respective reels 3L, 3C, 3R are stopped. Due to the combinations of symbols of the respective reels 3L, 3C, 3R which are observed with naked eyes through the respective panel display windows 5L, 5C, 5R at the time of stopping the rotations, prize-winning modes are decided. When the player wins the prize, coins the number of which corresponds to the prize-winning mode are delivered from a coin tray 8.

Figure 2:
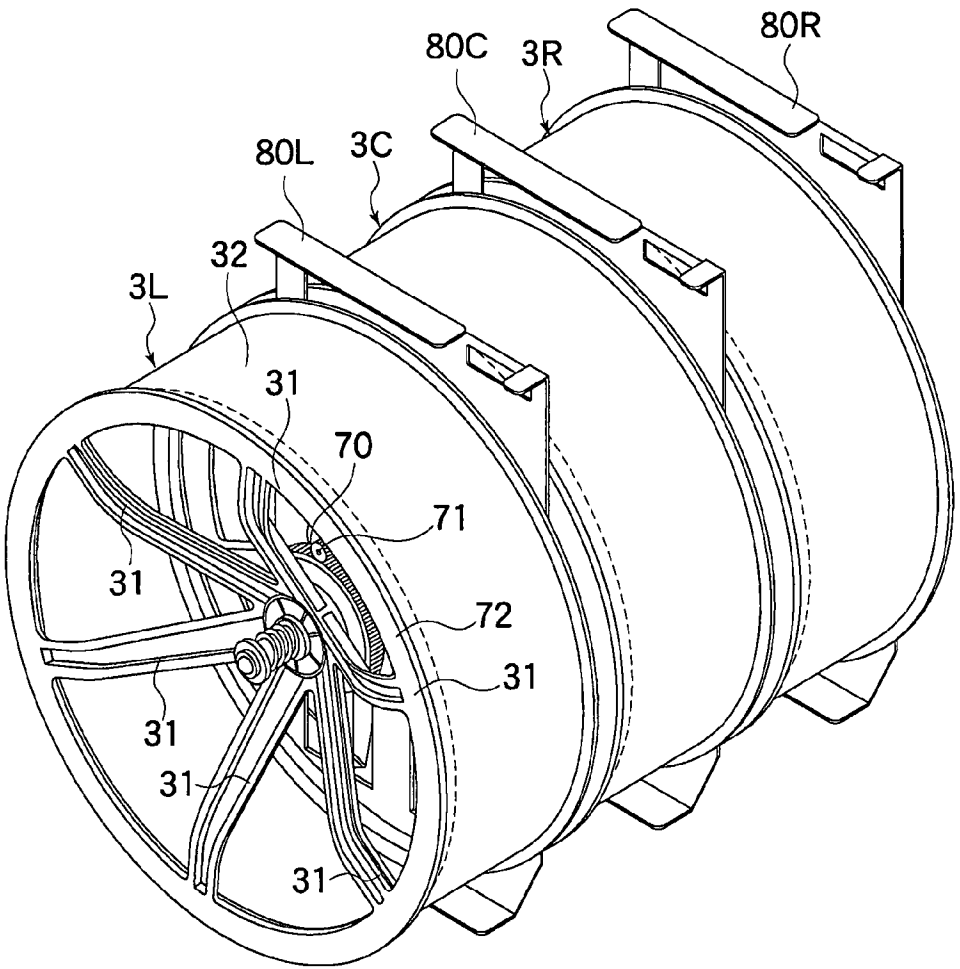
FIG. 2 is a perspective view showing the constitution of a reel of this embodiment as viewed from the oblique direction.

FIG. 2 is a perspective view showing the constitution of a reel unit provided to the inside of each panel display window 5L, 5C, 5R. As shown in FIG. 2, the reel unit includes three mounting plates 80L, 80C, 80R, three reels 3L, 3C, 3R which are arranged in the inside of the respective mounting plates 80L, 80C, 80R, and three PM-type stepping motors 70L, 70C, 70R which rotatably drive the reels 3L, 3C, 3R respectively.

For facilitating the explanation of the present invention, hereinafter, the explanation is made in a limiting manner with respect to the reel 3L (reel 3), the mounting plate 80L (mounting plate 80) and the stepping motor 70L (stepping motor 70) which are arranged at the right side out of three reels 3L, 3C, 3R, three mounting plates 80L, 80C, 80R and three stepping motors 70L, 70C, 70R. However, unless otherwise specified, the respective other reels 3C, 3R, the respective other mounting plates 80C, 80R and the respective other stepping motors 70C, 70R have the substantially equal constitution.

Figure 3:
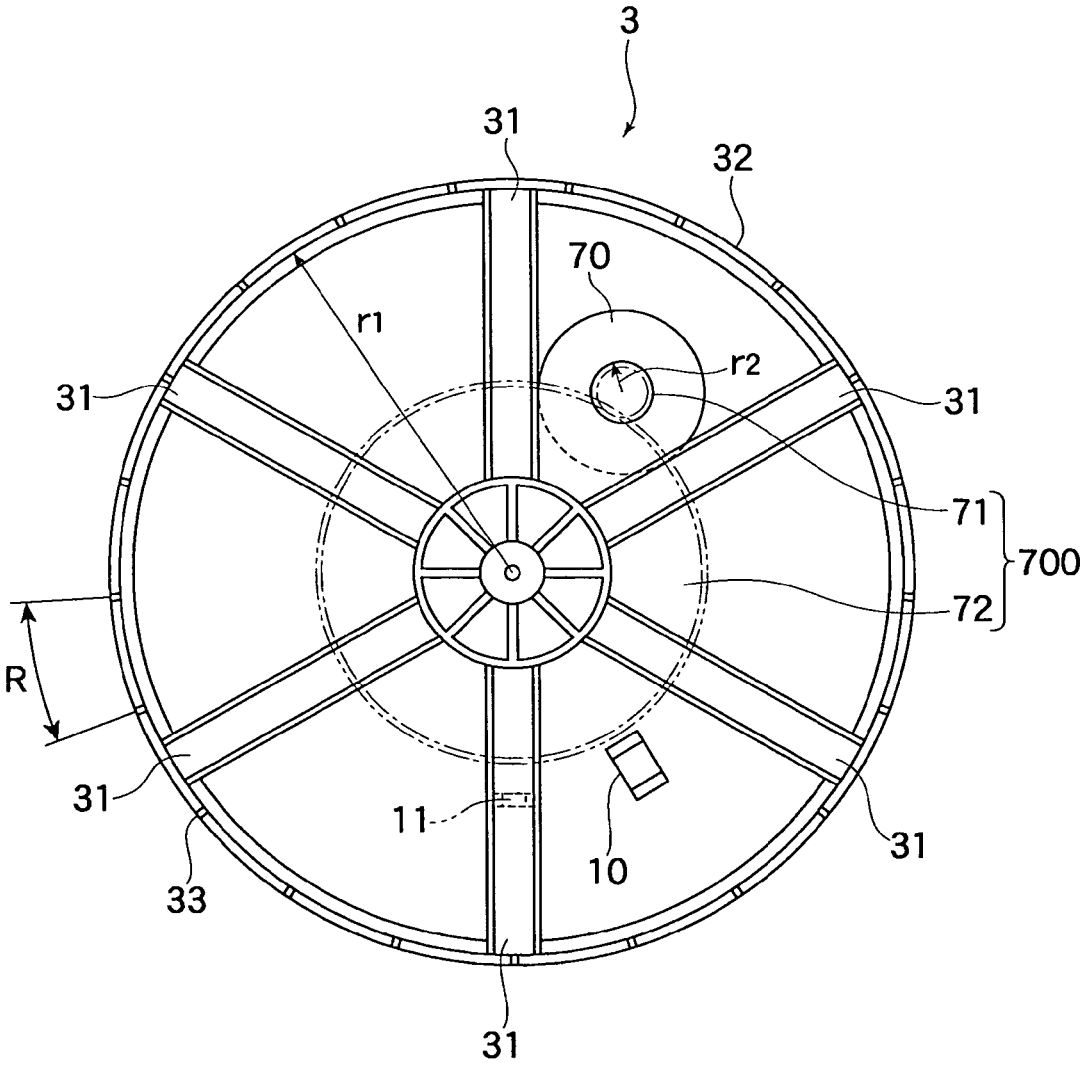
FIG. 3 is a view showing a side face of the reel of this embodiment.

FIG. 3 is a view showing the right side face of the reel 3. As shown in FIG. 3, a position detection sensor 10 which constitutes a reel position detection circuit for detecting a rotational position of the reel 3 is mounted on the mounting plate 80 (not shown in the drawing) within a radius of rotation r1 of the reel 3. The reel 3 has the center thereof rotatably and pivotally supported on a reel post 76 which extends perpendicularly from a surface of the mounting plate 80 (see FIG. 4).

The reel 3 is, as shown in FIG. 3, constituted of six arms 31 which extend radially from the center thereof and a cylindrical member 32 which is integrally formed with the arms 31 such that the cylindrical member 32 spans respective distal ends in the extending direction of the arms 31. A detection lug 11 which constitutes a reference position which is detectable by the position detection sensor 10 is formed on one of the arms 31. The detection lug 11 is arranged such that the detection lug 11 passes the position detection sensor 10 every one rotation of the reel 3. Further, the position detection sensor 10 is configured such that each time the detection lug 11 passes the position detection sensor 10 and the position detection sensor 10 detects the detection lug 11, the position detection sensor 10 can output a detection signal.

Between a drive shaft of the stepping motor 70 and a rotary shaft of the reel 3, as shown in FIG. 3, a speed reduction transmission mechanism 700 is provided. The speed reduction transmission mechanism 700 is provided for transmitting the rotation of the stepping motor 70 to the rotary shaft which rotates the reel 3 at a predetermined speed reduction ratio.

As shown in FIG. 3, the speed reduction transmission mechanism 700 includes two gears, that is, an output-side gear 71 which is provided to the drive side of the stepping motor 70 and an input-side gear 72 which is mounted on the reel 3 in a state that the input-side gear 72 is meshed with the output-side gear 71 and is arranged concentrically with the support shaft of the reel 3.

The output-side gear 71 and the input-side gear 72 are formed of a spur gear, for example. The number of teeth of the input-side gear 72 of this embodiment is set to a value seven times as large as the number of teeth of the output-side gear 71. Accordingly, the speed reduction transmission mechanism 700 is configured to transmit the rotation of the stepping motor 70 to the reel 3 by reducing the rotational speed of the stepping motor 70 to one seventh.

The gear ratio (speed reduction ratio) between the output-side gear 71 and the input-side gear 72 is obtained based on a ratio between the number of steps of one rotation of the stepping motor 70 and the least common multiple of the number of symbols displayed on the reel 3 and the number of steps of one rotation of the stepping motor 70.

To be more specific, for example, when the number of steps for one rotation of the stepping motor 70 is "48 steps" and the number of symbols displayed on the reel 3 is "21", the least common multiple of "48" and "21" becomes "336". Then, the ratio between "48" which is the number of steps for one rotation of the stepping motor 70 and the the least common multiple "336" becomes "48:336=1:7". Accordingly, the gear ratio between the output-side gear 71 and the input-side gear 72 is obtained based on "1:7×n (n being integers).

Further, when the rotational speed for one minute of the reel 3 is 80 rpm and the gear ratio is 1:7 (the above-mentioned n being 1), the rotational speed for one second of the stepping motor 70 becomes 1.33 rps. Accordingly, when the number of steps per one rotation of the stepping motor 70 is 48, the drive frequency of the stepping motor 70 becomes 448 pps (1.33 rps×the above-mentioned "336").

The drive frequency is within a range of proper drive frequency (approximately 300 to 500 pps) of the stepping motor 70 adopting two-phase excitation. Further, when "n" is 2 or more, the drive frequency of the stepping motor 70 becomes 896 pps or more based on the similar calculation and hence, the drive frequency does not fall within the range of the proper drive frequency.

Accordingly, the optimum condition is the combination with n being set to 1 (the rotational speed 80 rpm, the gear ratio 1:7, the number of steps 48). In view of the above, the proper speed reduction ratio is univocally decided based on the combination of "the least common multiple of the number of steps for one rotation of the stepping motor 70 and the number of symbols" and "the drive frequency of the stepping motor 70".

Figure 4A:
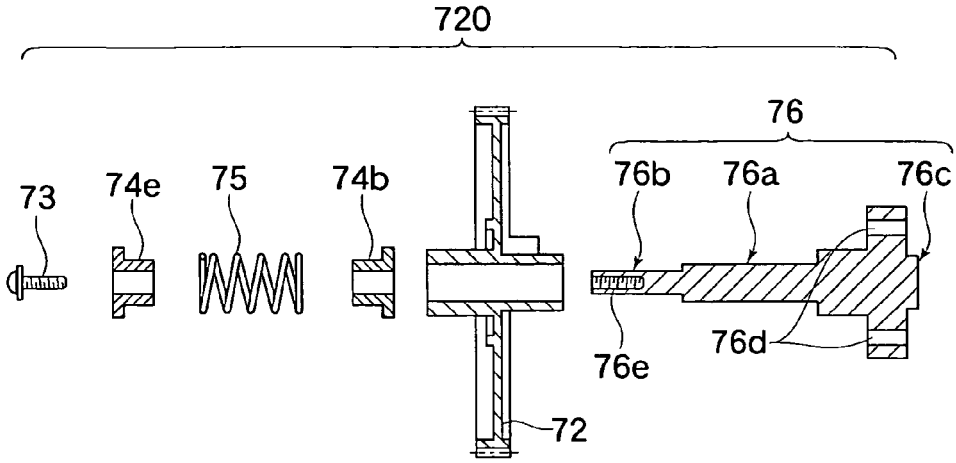
FIG. 4A is a view showing the structure of the pivotally supporting portion of this embodiment which rotatably and pivotally supports the reel.
Figure 4B:
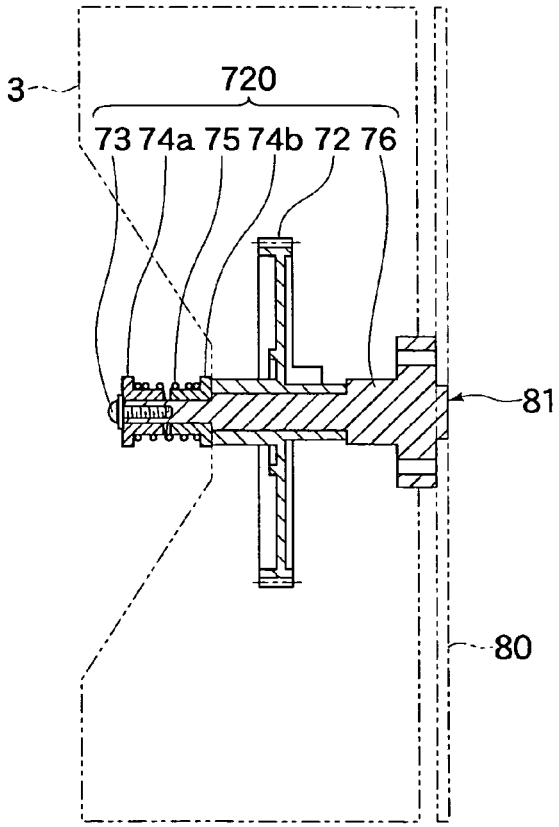
FIG. 4B is a cross-sectional view showing the structure which pivotally supports the reel by the pivotally supporting portion mounted on the mounting plate.
Figure 5:
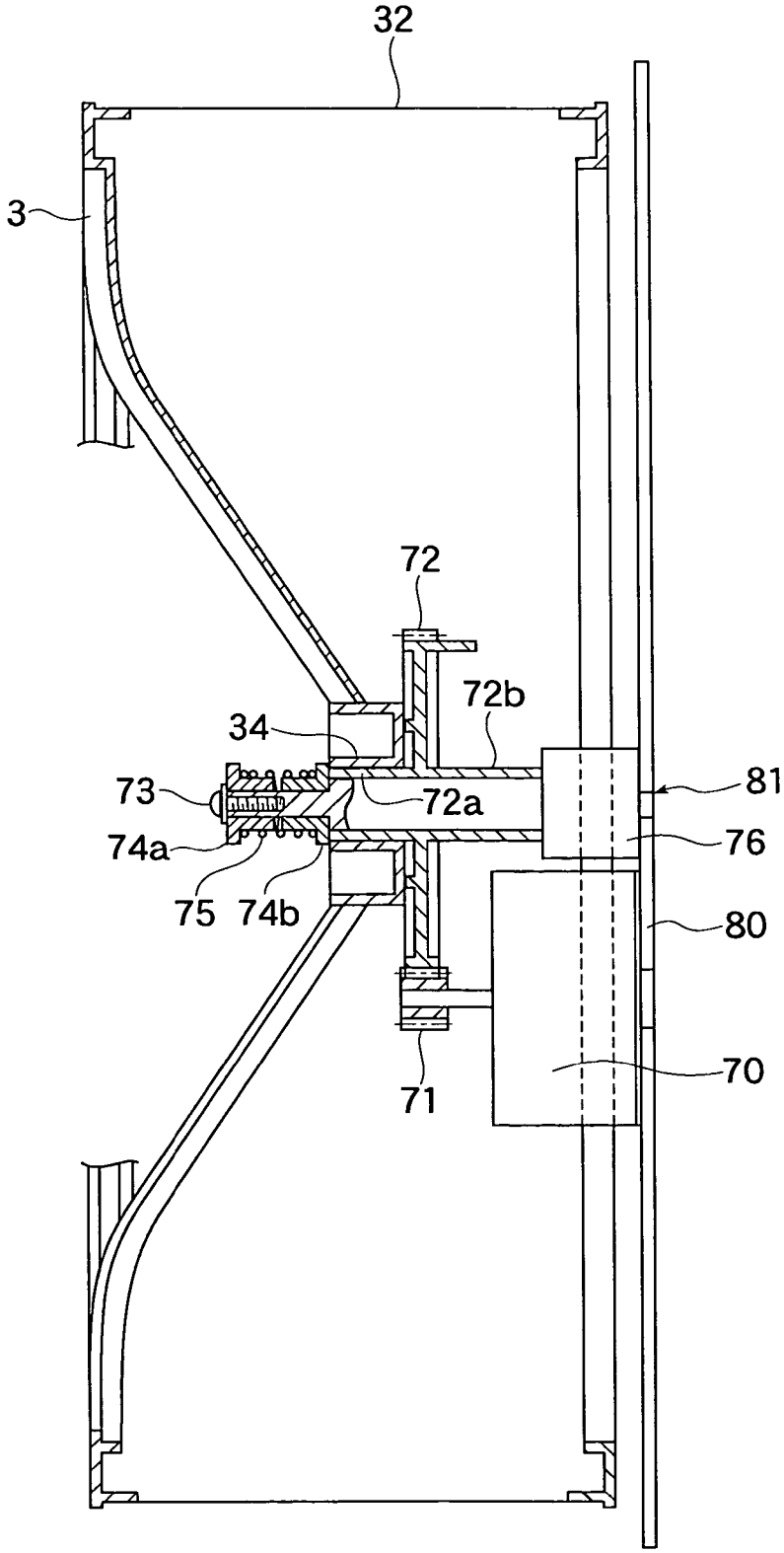
FIG. 5 is a cross-sectional view showing the structure in a state that the pivotal mounting portion of this embodiment is mounted on a mounting plate.

FIG. 4A is a view showing the structure of the pivotally supporting portion 720 which rotatably and pivotally supports the reel 3. FIG. 4B is a cross-sectional view showing the structure which pivotally supports the reel 3 by the pivotally supporting portion 720 mounted on the mounting plate 80. FIG. 5 is a cross-sectional view showing the whole structure which pivotally supports the reel 3 by the pivotally supporting portion 720.

As shown in FIG. 4A, the pivotally supporting portion 720 includes a stopper member 73, collars 74*a*, 74*b*, a vibration control member 75 and a reel post 76. The reel post 76 includes a rotary pivotally support portion 76*a* which allows fitting of the input-side gear 72 thereon and rotatably and pivotally supports the input-side gear 72, a position fixing portion 76*b* which allows an insertion of a member for fixing the position of the reel 3 therein, a projection portion 76*c* which projects from a bottom surface of the reel post 76 toward the mounting plate 80 and fits the reel post 76 in a hole 81 formed in the mounting plate 80, screw holes 76*d* which are formed for fixing the reel post 76 to the mounting plate 80 using screws, collars 74*a*, 74*b*, and a stopper hole 76*e* which detachably fasten the input-side gear 72 by way of the vibration control member 75 using the stopper member 73 (for example, screw).

The vibration control member 75 performs a braking function at the time of rotating the reel 3 due to the stop control by the main CPU 40 and, at the same time, attenuates the vibration of the reel 3 which is generated when the rotation of the reel 3 is stopped. As the vibration control member 75, a spring or the like can be named. In this embodiment, the vibration control member 75 is formed of a spring 75. As shown in FIG. 4B, after the input-side gear 72 is fitted on the rotary pivotally mounting portion 76*a*, the spring 75 is fitted on the position fixing portion 76*b* in a state that the spring 75 is sandwiched by the collars 74*a*, 74*b*.

The stopper member 73 is, as shown in FIG. 4*b*, replaceably inserted into the stopper hole 76*e* to stop the removal of the collars 74*a*, 74*b* and the spring 75 fitted on the position fixing portion 76*b*. The spring 75 whose removal is prevented by the stopper member 73 pushes down the input-side gear 72 toward the mounting plate 80 by way of the collar 74*b* by making use of a repulsive force which the spring 75 possesses. Due to a friction force which is generated by such an action of the spring 75 which constitutes the vibration control member, it is possible to attenuate the vibration of the reel 3 which is generated at the time of stopping the rotation of the reel 3.

As shown in FIG. 5, projection portions 72*a*, 72*b* are integrally formed with the input-side gear 72 such that projection portions 72*a*, 72*b* project perpendicularly from both faces of input-side gear 72 and have cavities which allow insertion of the rotatably and pivotally supporting portion 76*a* along an axis perpendicular to the input-side gear 72. The input-side gear 72 has one projection portion 72*b* thereof fit on the rotatably and pivotally supporting portion 76*a* toward the mounting plate 80. Another projection portion 72*a* is press-fitted into the hole 34 formed in the center portion of the reel 3. Accordingly, due to the rotation of the output-side gear 71, the real 3 and the input-side gear 72 are integrally rotated with the rotatably and pivotally supporting portion 76*a* about the rotatably and pivotally supporting portion 76*a*.

Figure 6:
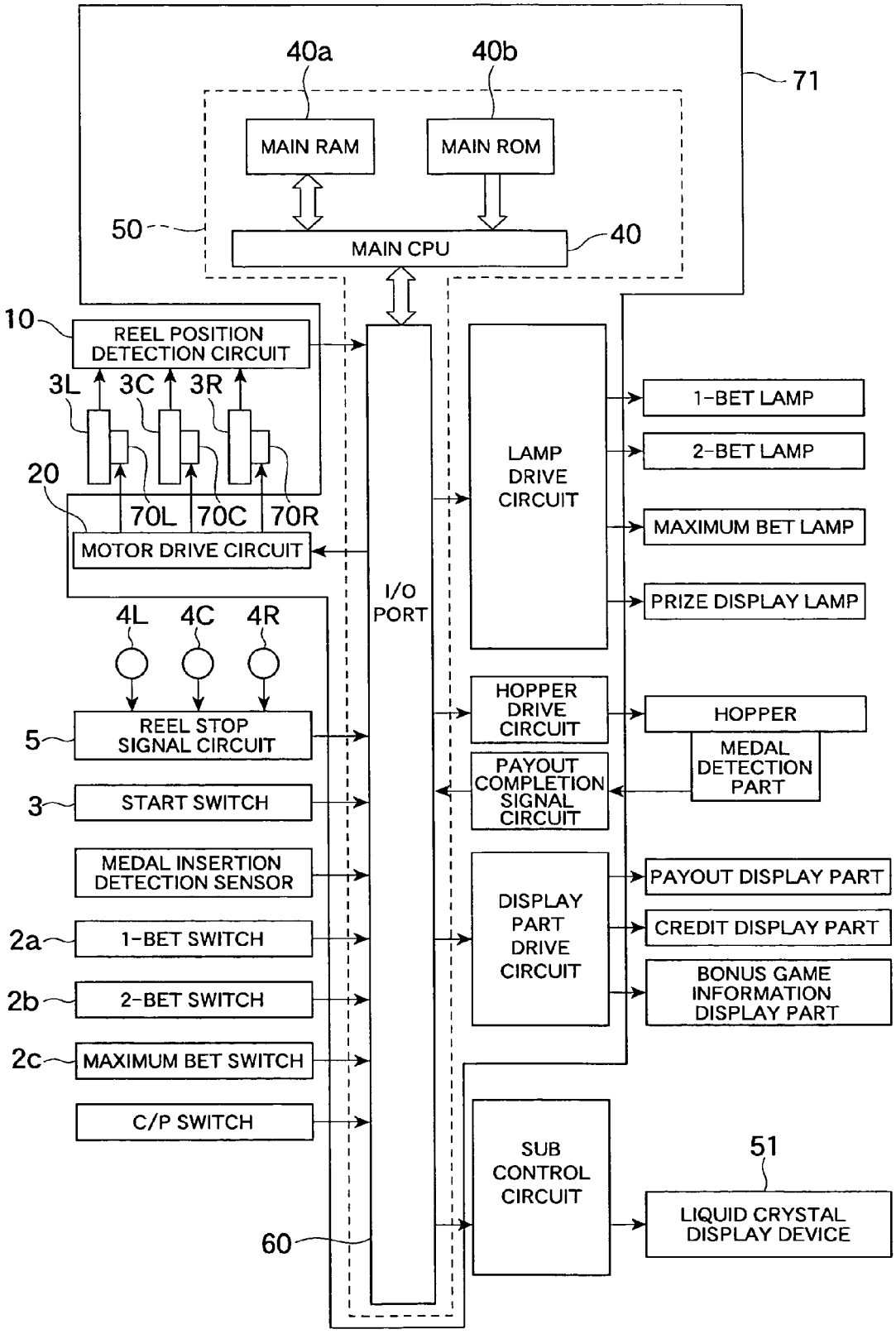
FIG. 6 is a view showing the inner structure of the game machine of this embodiment.

FIG. 6 is a block diagram showing the electric constitution of a gaming machine 1 including the motor stop control device. The motor stop control device includes the stepping motor 70 which has two pairs of excitation phases as a drive source of the reel 3 on which a plurality of symbols are displayed and the stepping motor 70 is stopped in response to a manipulation command from the outside.

As shown in FIG. 6, the microcomputer includes a main CPU (motor stop processing means) 40 which constitutes a main part which executes control and arithmetic operation, a program ROM 40*b* in which programs and fixed data are stored, a control RAM 40*a* which is served for reading and writing of data and a random number generator (not shown in the drawing) which generates predetermined random number values.

To the main CPU 40, by way of a bus 60, respective input parts such as a start switch 3 which detects the manipulation of a start lever 9, a reel stop signal circuit 5 which detects the manipulation of the stop buttons 4L, 4C, 4R, BET switches 2*a* to 2*c* for betting credited medals by the push button manipulation and the like, and respective output parts such as a motor drive circuit 20, a medal payout part (not shown in the drawing), a play effect control execution part 50 and the like are connected.

The play effect control execution part 50 executes the effect in accordance with lottery processing based on a command transmitted from the main CPU. To be more specific, the play effect control execution part 50 outputs a command to a liquid crystal display device 51 for instructing the liquid crystal display device to perform a variable display of a plurality of symbols.

The motor drive circuit 20 is configured to drive or stop the stepping motor 70 based on the command from the main CPU 40. Here, the stepping motor 70 is a four-phase motor and includes drive coils of a phase A to phase D. Further, in this embodiment, these phases are arrange in order of the phase A, the phase B, the phase C and the phase D in the counter direction. Further, the phase A and the phase C form one pair or the phase C and phase D form one pair, wherein in one phase out of two phases which constitute the pair, a current which has a phase opposite to a phase of a current which flows into another phase flows.

The motor drive circuit 20 sequentially excite the drive coils of respective phases based on the command from the main CPU 40, a rotor disposed in the inside of the stepping motor 70 is rotatably driven. In driving the stepping motor 70, to respective bipolar transistors (or unipolar transistors) which are provided to respective phases of the motor drive circuit 20, pulses whose phase is offset are supplied from the main CPU.

As a drive system of the stepping motor, the one-phase excitation system, the two-phase excitation system and the "one-to-two phase excitation" system are known. In this embodiment, the two-phase excitation system which excites two phases drive coil simultaneously is used. The two-phase excitation (for example, the phase C and the phase D), in this embodiment, implies that, with respect to two pairs of excitation phases, an electric current flows into these two excitation phases in such a manner that the directions of magnetic fields which are generated in these two excitation phases become equal,. With the stop control which adopts this two phase excitation (for example, the phase C and the phase D), it is possible to obtain the strong braking force compared to the full-phase excitation, the one-phase excitation and the three-phase excitation.

The main CPU 40 is winning combination decision means which decides predetermined combinations as winning combinations (lottery processing). To be more specific, the main CPU 40, when the start switch detects the manipulation of the start lever 9 by the start switch 3, decides the predetermined combination as the winning combinations.

The main CPU 40 is traveling decision means which decides the number of slid frames of symbols displayed on the liquid crystal display device at a point of time that a stop instruction (command) of the stepping motor 70 is generated. To be more specific, when the predetermined combination is decided as the prize-wining combination, the main CPU 40 pulls the symbol which corresponds to the decided predetermined combination in the prize line and executes the stop control. On the other hand, when the predetermined combination is not decided as the winning combination, the main CPU 40 executes the frame slide processing which prevents the timing of the stop manipulation by the stop button 4L, 4C, 4R from bringing about the winning combination (processing which slides the symbol by the number of decided slid frames) and, thereafter, executes the stop control.

The main CPU 40 is motor stop control means which, when a command for stopping the stepping motor 70 is generated in response to the command from the outside (manipulation of the start lever 9), selects either one of reel stop control processing 1 (the first processing) which executes a stop control based on the all-phase excitation with respect to the stepping motor 70 and reel stop control processing 2 (the second processing) which executes a control based on the two-phase excitation to reduce a rotational speed of the stepping motor 70 and, thereafter, executes the stop control with respect to the stepping motor 70.

The main CPU 40 according to this embodiment selects the reel stop control processing 1 when the decided number of slid frames does not fall within a range of preset predetermined number of symbols, while the main CPU 40 selects the reel stop control processing 2 when the decided number of slid frames falls within the range of preset predetermined number of symbols.

Here, FIG. 7 is a view showing a selection table 1 which is served for selecting either one of the reel stop control processing 1 or the reel stop control processing 2. As shown in FIG. 7, the selection table 1 is a table showing a correspondence between the number of slid frames and the reel stop control processing. To be more specific, when the number of slid frames falls within the range of preset number of symbols (for example, "3"), the reel stop control processing 2 corresponds to the number of slid frames. On the other hand, when the number of slid frames does not fall within the range of preset number of symbols (for example, "3"), the reel stop control processing 1 is made to correspond to the number of slid frames.

For example, when the number of slid frames is "3", the main CPU 40 selects the reel stop control processing 1 which is made to correspond to the number of slid frames "3" by reference to the selection table 1 shown in FIG. 7.

Further, when the main CPU 40 decides the predetermined combination as the winning combination, either one of the reel stop control processing 1 and the reel stop control processing 2 may be selected corresponding to the decided winning combination.

Here, FIG. 8 is a view showing a selection table 2 which is served for selecting either one of the reel stop control processing 1 or the reel stop control processing 2. As shown in FIG. 8, the selection table 2 is a table showing a correspondence between the winning combinations and the reel stop control processing.

For example, when the winning combination is "watermelon", the main CPU 40 selects the reel stop control processing 1 which is made to correspond to the winning combination "watermelon" by reference to the selection table 2 shown in FIG. 8.

Here, FIG. 9 is a view showing contents of the reel stop control processing. As shown in FIG. 9, the reel stop control processing includes "stop processing" ranging from the push-down operation of any one of the stop buttons 4 to the starting of the "excitation processing" and "excitation processing" ranging from the finishing of the "stop processing" to the complete stop of the reel 3. Here, the stop processing is not limited to the stop operation performed by pushing the stop buttons. It may include a stop control of the reels based on a program stored in the main circuit. For example, the reel may be stopped after a lapse of a predetermined time using a timer.

The "stop processing" shown in FIG. 9 includes "symbol processing" which executes processing for pulling the symbol corresponding to the prize winning decided by the main CPU 40 into the prize line or processing for sliding the symbol which corresponds to the predetermined combination decided by the main CPU 40 during a period immediately before the reel 3 is stopped at the target stop position from a point of time that the stop button 4 is pushed downwardly and "speed reduction processing" which executes processing for reducing the rotational speed of the stepping motor 70 at the time of stopping during a period from the finishing of the "symbol processing" to the stopping of the reel 3 at the target stop position. Here, the "speed reduction processing" of this embodiment adopts the two-phase excitation (for example, phase B and phase C).

The above-mentioned reel stop control processing includes the reel stop control processing 1 and the reel stop control processing 2. As shown in FIG. 9, the reel stop control processing 1 includes "symbol processing" and "excitation processing". On the other hand, the reel stop control processing 2 includes "symbol processing", "speed reduction processing" and "excitation processing". The reel stop control processing 1 and the reel stop control processing 2 are explained in detail in order hereinafter.

(a) Reel Stop Control Processing 1

Figure 10:
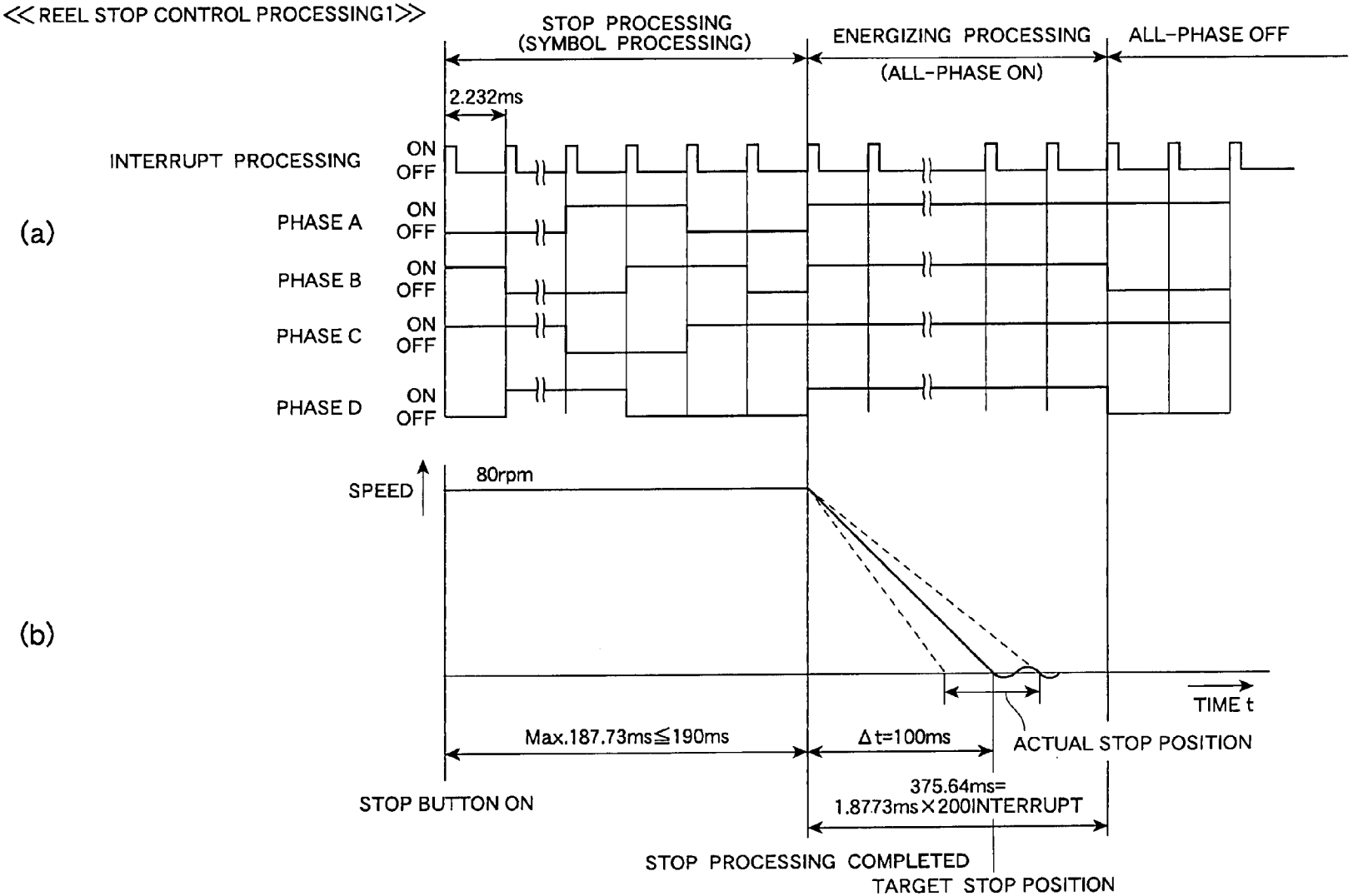
FIG. 10 is a view showing contents of "reel stop control processing 1" of this embodiment.

FIG. 10 is a drawing showing a timing chart of the reel stop control processing 1. An upper portion (a) of FIG. 10 shows pulses of respective phases which the main CPU 40 transmits to the motor drive circuit 20 in the "stop processing" and the "excitation processing". A lower portion (b) of FIG. 10 shows the rotational speed of the reel 3 with respect to time when the motor drive circuit 20 drives the stepping motor 70 in response to pulses of respective phases which the motor drive circuit 20 receives from the main CPU 40. The time shown in the lower portion (b) of FIG. 10 of this embodiment corresponds to the time shown in the upper portion (a) of FIG. 10.

Here, a space defined by two dotted lines shown in the lower portion (b) of FIG. 10 shows within the range of irregularities of the actual stop position. The actual stop position is decided based on the balance between a detent torque of the stepping motor 70 and inertia of the reel 3. Accordingly, actual stop position is changed due to this balance. Here, since the "reel stop control processing 2" described hereinafter adopts the "speed reduction processing", the irregularities of the above-mentioned "actual stop position" become substantially 0.

In this reel stop control processing 1, as shown in the upper portion (a) and the lower portion (b) of FIG. 10, when the push button 4 is pushed downwardly, the above-mentioned "symbol processing" is executed and, thereafter, "excitation processing" of full-phase excitation is executed to stop the reel 3.

(b) Reel Stop Control Processing 2

Figure 11:
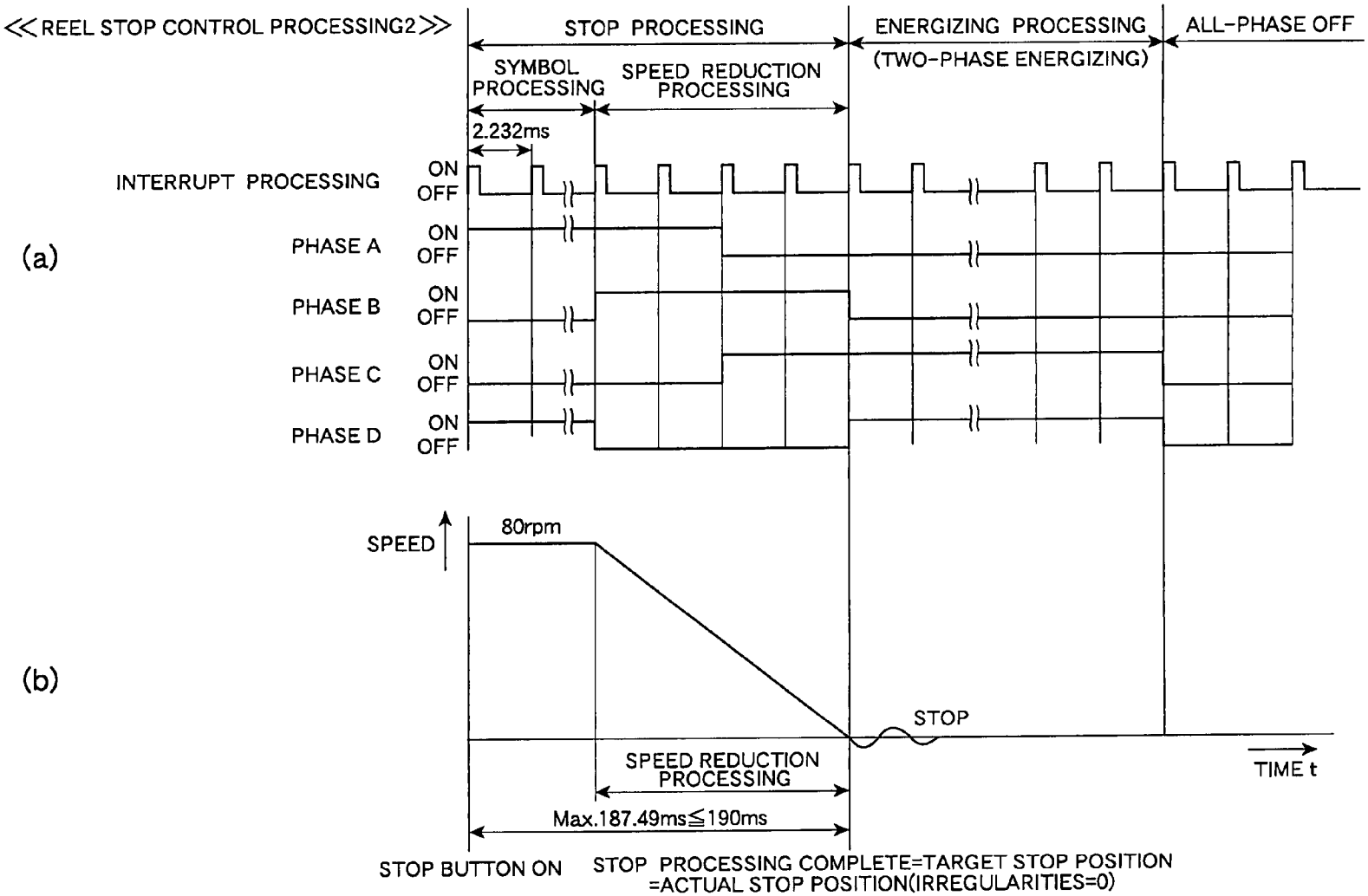
FIG. 11 is a view showing contents of "reel stop control processing 2" of this embodiment.

FIG. 11 is a view showing contents of the reel stop control processing 2. An upper portion (a) of FIG. 11 is a view showing pulses of respective phases which the main CPU 40 transmits to the motor drive circuit 20 in the "stop processing" and the "excitation processing". A lower portion (b) of FIG. 11 is a view showing the rotational speed of the reel 3 with respect to time when the motor drive circuit 20 drives the stepping motor 70 in response to pulses of respective phases which the motor drive circuit 20 receives from the main CPU 40. The time shown in the lower portion (b) of FIG. 11 of this embodiment corresponds to the time shown in the upper portion (a) of FIG. 11.

In this reel stop control processing 2, when a command for stopping the stepping motor 70 is generated in response to a manipulation instruction from the outside, the main CPU 40 executes the control which reduces a rotational speed of the stepping motor 70 to a rotational speed lower than a rotational speed under uniform rotation and, thereafter, the main CPU executes the stop control based on two-phase excitation with respect to the stepping motor 70.

To be more specific, in the reel stop control processing 2, as shown in FIG. 11, when the push button 4 is pushed downwardly, the main CPU 40 executes "symbol processing" and, thereafter, the main CPU 40 executes "speed reduction processing". Then, the main CPU 40 executes the "excitation processing" of two-phase excitation so as to stop the reel 3.

In the above-mentioned "speed reduction processing", the main CPU 40 transmits a command for reducing the uniform rotational speed (for example, 80 rpm) of the reel 3 to the predetermined rotational speed (for example, 40 rpm) to the motor drive circuit 20 for hours corresponding to predetermined number of interrupts.

To be more specific, as shown in FIG. 11, the main CPU 40 transmits pulses for generating the two-phase excitation as the command for reducing the uniform rotational speed (for example, 80 rpm) of the reel 3 to the predetermined rotational speed (for example, 40 rpm) to the motor drive circuit 20 for a predetermined time interval. The motor drive circuit 20 which receives the pulses for generating the two-phase excitation excites the phase B and the phase C, for example, based on the received pulses and reduces the rotational speed of the rotor (to 40 rpm, for example).

Here, when the "speed reduction processing" is completed, the main CPU 40 executes the "excitation processing" based on the two-phase excitation. In the "excitation processing" based on the two-phase excitation, as shown in FIG. 11A, the main CPU 40 transmits pulses which excite the phase C and the phase D, for example, to the motor drive circuit 20 after finishing the "speed reduction processing". The motor drive circuit 20 excites the phase C and the phase D, for example, for a predetermined time interval in response to the received pulse. By continuously performing the "excitation processing" for a predetermined time interval, the stepping motor 70 is completely stopped.

Here, the speed reduction transmission mechanism 700 has the speed reduction ratio of "1:n" (for example n=7) and hence, the moment of inertia J' which is generated when the reel 3 is rotated becomes a value (J/n) obtained by dividing the moment of inertia J when the speed reduction transmission mechanism 700 is not provided with n at the speed reduction ratio of "1:n".

Accordingly, the detent torque Td1 in the above-mentioned reel stop control processing 1 and reel stop control processing 2 becomes 1/n of the detent torque Td when the speed reduction transmission mechanism 700 is not provided in accordance with the above-described formula on moment of inertia J'. Further, the brake time Δt1 in the reel stop control processing 1 and reel stop control processing 2 also becomes a value which is obtained by dividing the brake time Δt when the speed reduction transmission mechanism 700 is not provided by n in the speed reduction ratio "1:n" based on the above-mentioned formula of the moment of inertia J'.

Figure 12:
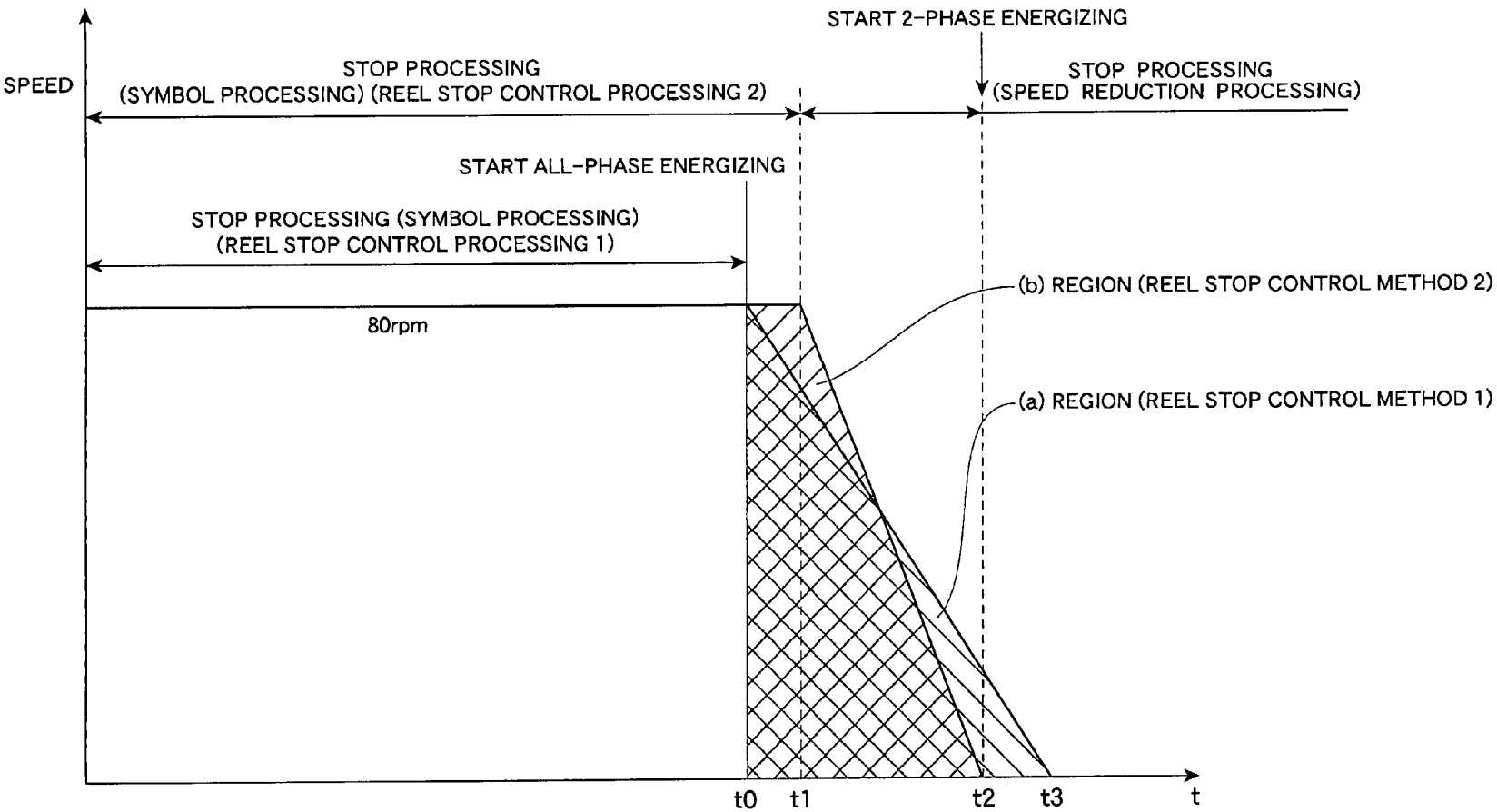
FIG. 12 is a view showing the relationship between "the reel stop control processing 1" and the "reel stop control processing 2" of this embodiment.

Further, FIG. 12 is a view showing the rotational speed of the reel 3 with respect to time when the motor drive circuit 20 drives the stepping motor 70 in response to pulses of respective phases received from the main CPU 40 in both of the reel stop control processing 1 and the reel stop control processing 2 (speed characteristic chart).

The speed characteristic shown in FIG. 12 is a characteristic which allows the stop position of the symbol when the reel stop control processing 1 is applied and the stop position of the symbol when the reel stop control processing 2 is applied to assume the same position. To be more specific, as shown in FIG. 12, the "stop processing" and the "excitation processing" are executed in respective methods such that an area of a region (a) when the reel stop control processing 1 is applied and an area of a region (b) when the reel stop control processing 2 is applied become equal. The area of the region (a) and the area of the region (b) correspond to the movement distance of the reel. Accordingly, as long as the reel stop control processing 1 and the reel stop control processing 2 are executed such that the area of the region (a) and the area of the region (b) become equal, the motor stop control device can obtain the same stop position of the symbol whichever processing is used.

The area of the region (a) in the reel stop control processing 1 is formed of a triangular area in which the time ranging from a point of time t0 at which the "stop processing" is finished to a point of time t3 at which the rotational speed of the reel 3 becomes 0 due to the full-phase excitation constitutes a "bottom side" and the rotational speed of the reel 3 at a point of time t0 at which the "stop processing" is finished constitutes a "height".

The area of the region (b) in the reel stop control processing 2 is formed of a trapezoidal area in which the time ranging from a point of time t0 at which the full-phase excitation in the reel stop control processing 1 is started to a point of time t1 at which the "stop processing" in the reel stop control processing 2 is finished constitutes an "upper bottom", the time ranging from the point of time t0 at which the full-phase excitation in the reel stop control processing 1 is started to a point of time t2 at which the "speed reduction processing" in the reel stop control processing 2 is finished constitutes a "lower bottom", and the rotational speed of the reel 3 at a point of time t1 at which the "stop processing" is finished constitutes a "height".

To allow the area of the region (a) and the area of the region (b) to become equal, timing for executing the "stop processing" and the "excitation processing" is preliminarily determined. The main CPU 40 executes the "stop processing" and the "excitation processing" in the reel stop control processing 1 or in the reel stop control processing 2 in accordance with the timing.

As shown in FIG. 12, to compare the reel stop control processing 1 and the reel stop control processing 2, they differ with respect to the inclination of lowering from the fixed rotational speed to 0. To be more specific, the reel stop control processing 1 uses the full-phase excitation in the "excitation processing" and hence, the time from the staring of the execution of the "stop processing" to the complete stop of the reel 3 is longer than the corresponding time of the reel stop control processing 2. On the other hand, the reel stop control processing 2 uses the two-phase excitation as the "excitation processing" and uses the "speed reduction processing" and hence, the time from the staring of the execution of the "stop processing" to the complete stop of the reel 3 is shorter than the corresponding time of the reel stop control processing 1.

As described above, when the reel stop control processing 1 is used, the time until the reel 3 is stopped is prolonged and hence, it appears to a player that the reel 3 is gently and slowly stopped. On the other hand, when the reel stop control processing 2 is used, the time until the reel 3 is stopped is shortened and hence, it appears to the player that the reel 3 is quickly stopped.

(Reel Stop Control Method by Motor Stop Control Device)

The reel stop control method which uses the motor stop control device having the above-mentioned constitution is executed in accordance with following steps. FIG. 13 to FIG. 16 are views showing the manner of operation of the motor stop control device.

Figure 13:
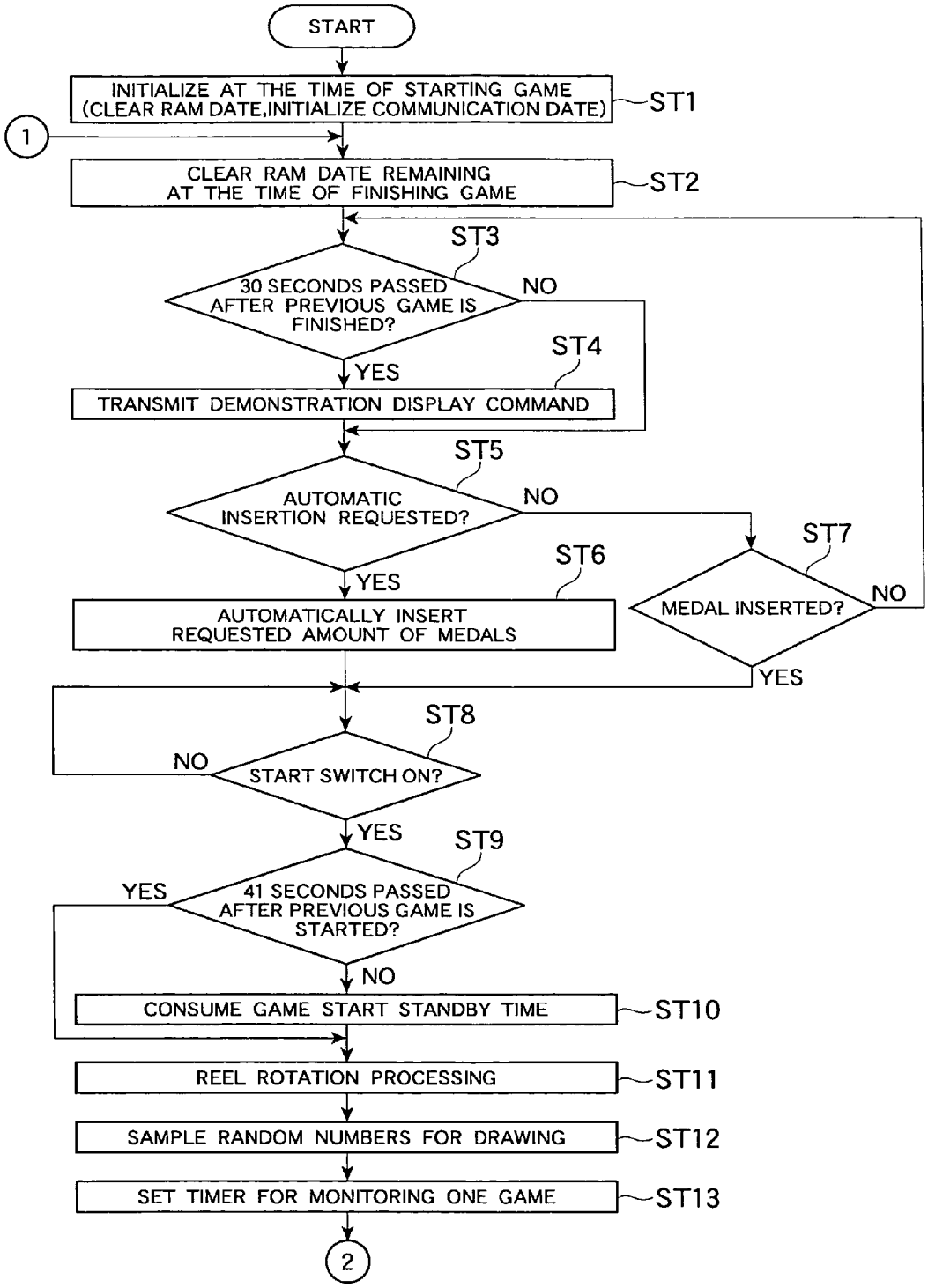
FIG. 13 is a view showing the manner of operation of a reel stop control method of this embodiment (first operation)
Figure 14:
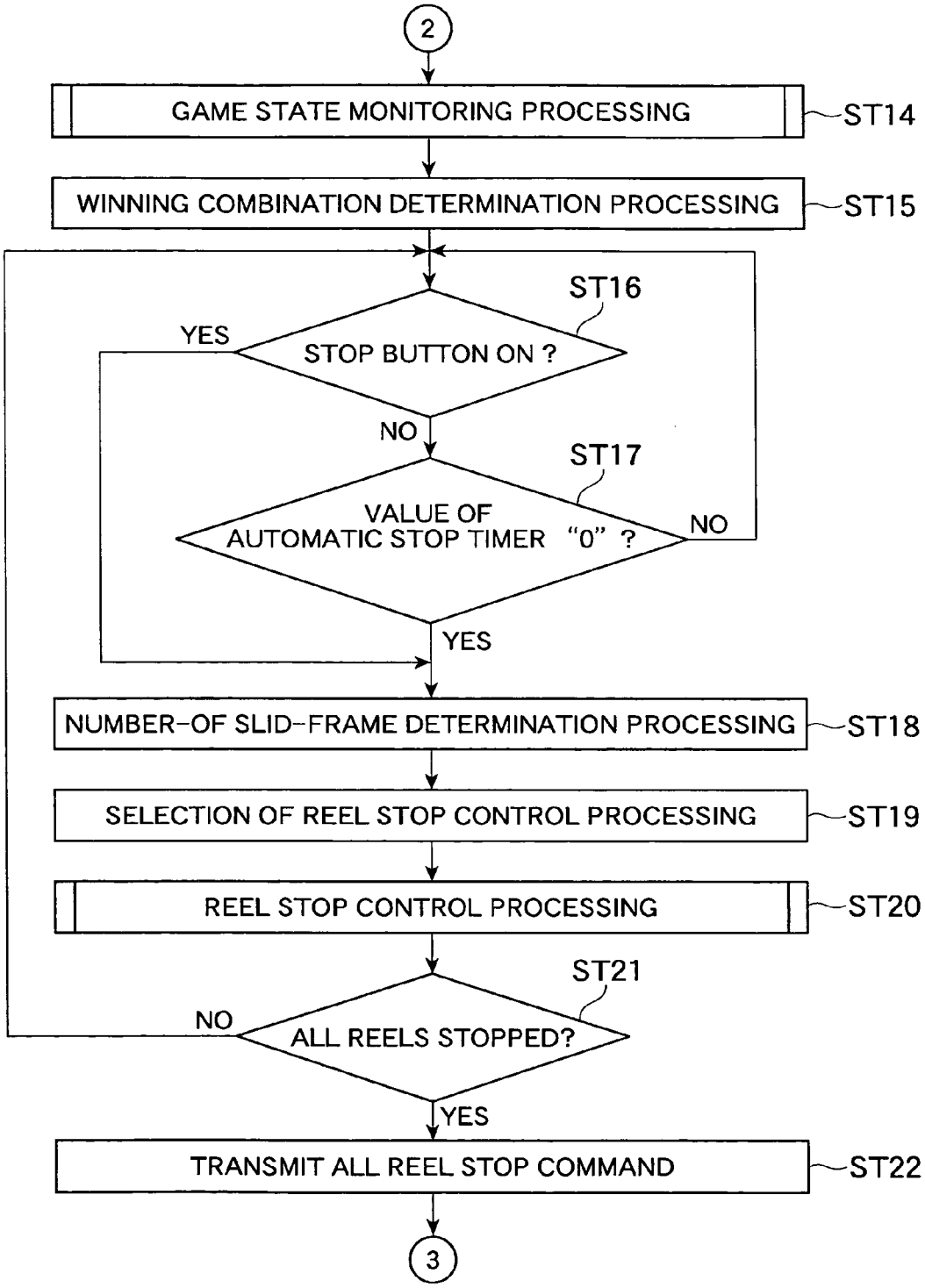
FIG. 14 is a view showing the manner of operation of a reel stop control method of this embodiment (second operation)
Figure 15:
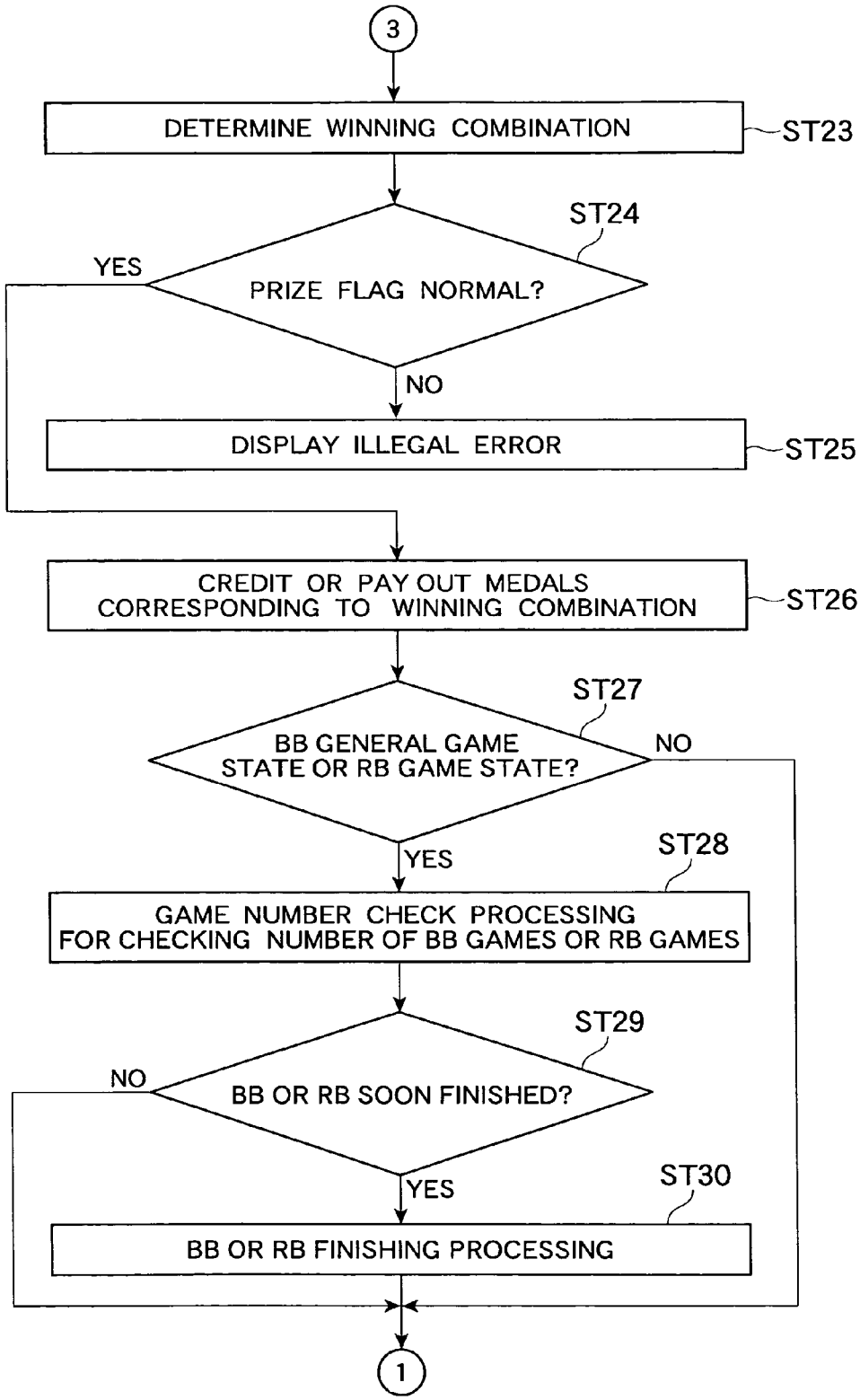
FIG. 15 is a view showing the manner of operation of a reel stop control method of this embodiment (third operation)

As shown in FIG. 13, in step 1, the main CPU 40 initializes predetermined data (data stored in the main RAM 33, communication data and the like)

In step 2, the main CPU 40 erases the predetermined data stored in the main RAM 33 at a point of time that the previous game is finished. To be more specific, the main CPU 40 erases parameters used in the previous game from the main RAM 33 and writes parameters which are used in the next game in the main RAM 33.

In step 3, the main CPU decides whether 30 seconds have passed from the point of time that the previous game is finished (when all reels (3L, 3C, 3R are stopped) or not. Further, the main CPU 40 executes the processing of step 4 when 30 seconds have already passed and executes the processing of step 5 when 30 seconds have not yet passed.

In step 4, the main CPU 40 transmits a "demonstration display command" which instructs the display of "demonstration image" to a sub control circuit 72.

In step 5, the main CPU 40 decides whether a player accomplished the prize "replay" in the previous game or not Further, the main CPU 40 executes step 6 when the player has accomplished the prize "replay" and executes step 7 when the player has not yet accomplished the prize.

In step 6, the main CPU 40 automatically inserts a predetermined number of medals based on the fact that the player has won the prize "replay".

In step 7, the main CUP 40 decides whether a medal is inserted by the player or not. To be more specific, the main CPU 40 decides whether there is an input from an inserted medal sensor or BET switches 2*a* to 2*c* or not. Further, the main CPU 40 executes the processing of step 8 when there is an input and executes the processing of step 3 when there is no input.

In step 8, the main CPU 40 decides whether the start lever 9 is operated by the player or not. To be more specific, the main CPU 40 decides whether there is an input from the start switch 3 or not. Further, the main CPU 40 executes the processing of step 9 when there is an input from the start switch 3.

In step 9, the main CPU 40 decides whether 4.1 seconds have passed since the previous game started or not. Further, the main CPU 40 executes the processing of step 11 when 4.1 seconds have passed and executes the processing of step 10 when 4.1 seconds have not passed.

In step 10, the main CPU 40 makes the input from the start switch 3 invalid until 4.1 seconds have passed since the previous game started.

In step 11, the main CPU 40 transmits a command which instructs the reel to rotate to a motor drive circuit 39.

In step 12, the main CPU 40 samples random numbers used for various decisions.

In step 13, the main CPU 40 sets a predetermined time to a one-game monitoring timer. Here, the one-game monitoring timer includes an automatic stop timer or the like to which a predetermined time is set for automatically stopping the reels 3L, 3C, 3R without the stop operation which is executed by the player.

In step 14, the main CPU 40 executes the game state monitoring processing.

In step 15, the main CPU 40 decides the predetermined combination as a winning combination based on the predetermined lottery result.

In step 16, the main CPU 40 decides whether stop buttons 4L, 4C, 4R are operated by the player or not. To be more specific, the main CPU 40 decides whether an input from the reel stop signal circuit 46 is the ON state or not. Further, the main CPU 40 advances to the processing of step 18 when the input is in the ON state and advances to the processing of step 17 when the input is in the OFF state.

In step 17, the main CPU 40 decides whether the value of the automatic stop timer is "0" or not. Further, the main CPU 40 executes the processing of step 18 when the value of the automatic stop timer is "0" and executes the processing of step 16 when the value of the automatic stop timer is not "0".

In step 18, the main CPU 40 decides the number of slid frames of the symbol.

In step 19, the main CPU 40 selects either one of the reel stop control processing 1 and the reel stop control processing 2 corresponding to the decided number of slid frames of the symbol or the decided winning combination. To be more specific, the main CPU 40 selects one reel stop control processing using FIG. 7 or FIG. 8.

Figure 16A:
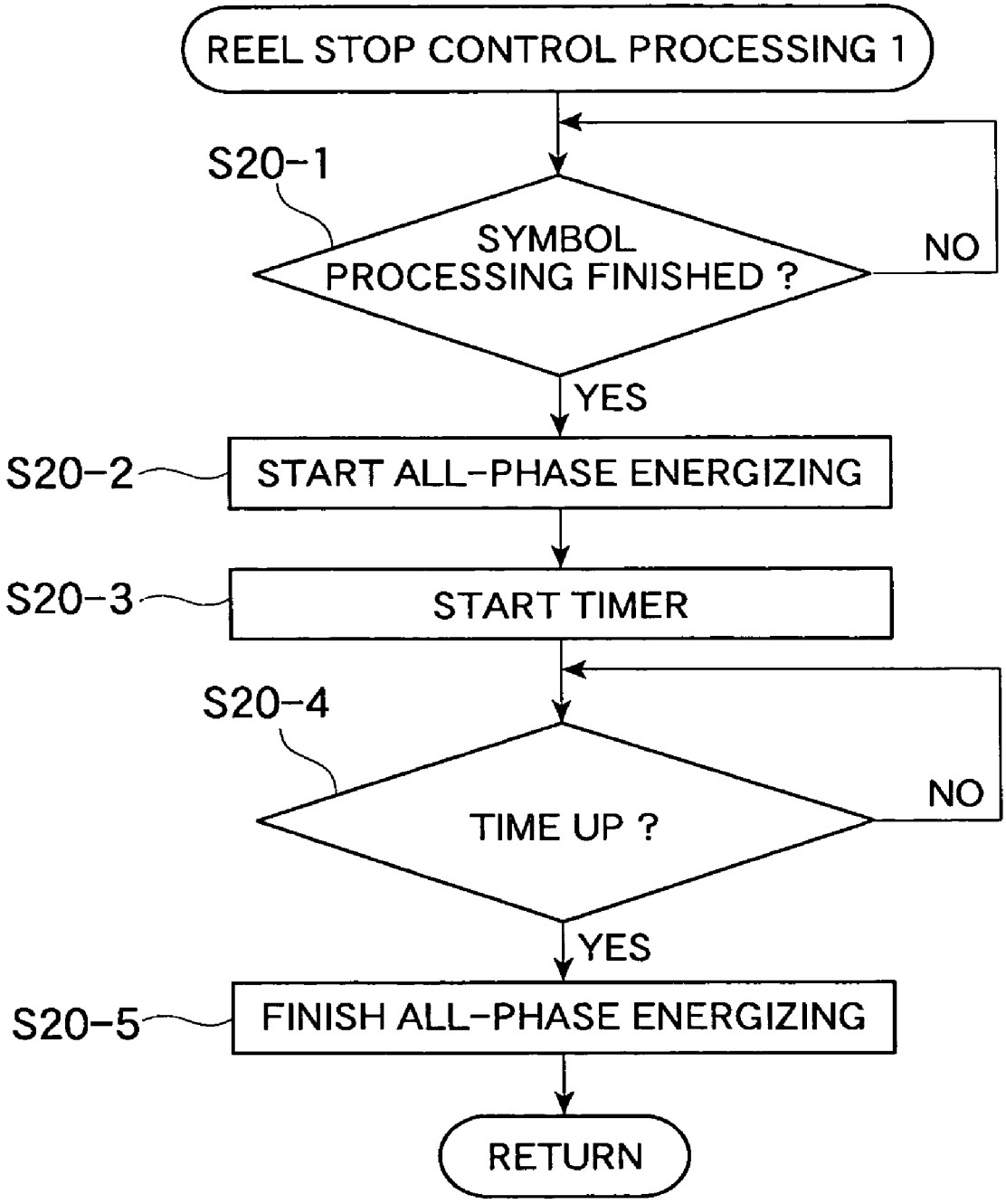
FIGS 16A and 16B are views showing the manner of operation of the reel stop control processing 1 and the reel stop control processing 2 of this embodiment.
Figure 16B:
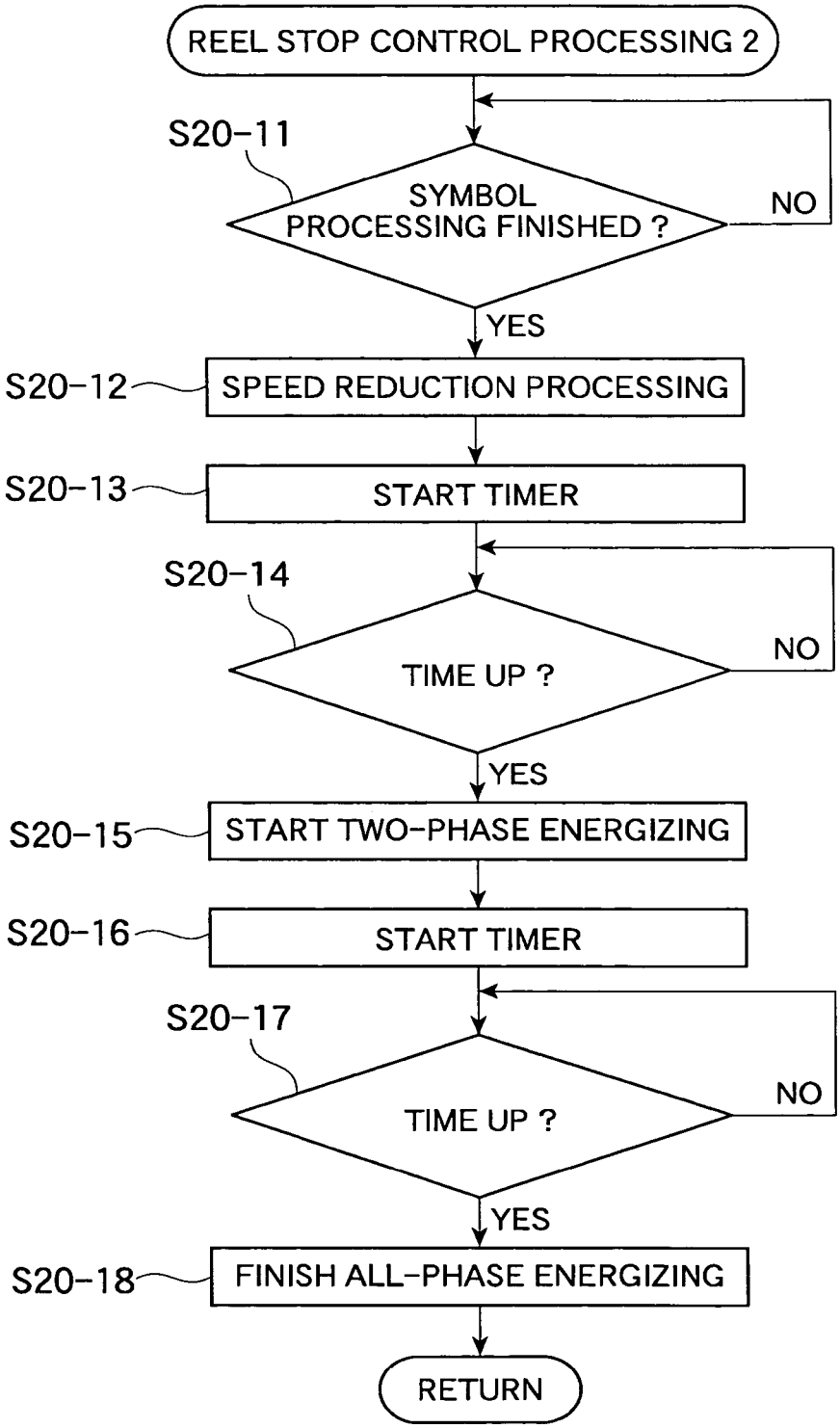

In step 20, the main CPU executes the selected reel stop control processing 1 or the reel stop control processing 2. Here, FIG. 16A is a view showing an operation of the reel stop control processing 1. FIG. 16B is a view showing an operation of the reel stop control processing 2.

When the main CPU 40 selects the reel stop control processing 1, as shown in FIG. 16A, in step 20-1, the main CPU 40 decides whether "symbol processing" in "stop processing" is finished or not. Further, the main CPU 40 repeats this processing when the "symbol processing" is not finished and advances to step 20-2 when the "symbol processing" is finished.

In step 20-2, the main CPU 40 starts "excitation processing" based on the all-phase excitation.

In step 20-3, the main CPU 40 counts the time of "excitation processing" executed by all phase excitation.

In step 20-4, the main CPU 40 decides whether the time which is counted by step 20-3 exceeds the predetermined time or not. Further, the main CPU 40 repeats this processing when the counted time does not exceed the predetermined time and advances to step 20-5 when the counted time exceeds the predetermined time.

In step 20-5, the main CPU 40 finishes the "excitation processing" based on all-phase excitation.

When the main CPU 40 selects the reel stop control processing 2, the main CPU 40 further executes the processing of step 20-12 to step 20-14 shown in FIG. 16B which are arranged between step 20-1 to step 20-2 in the reel stop control processing 1. With respect to the other processing (step 20-11, step 20-15 to 20-18), since the explanations are similar as the reel stop control processing 1 shown in FIG. 16A, the detailed explanation is omitted.

In step 20-12, the main CPU 40 executes "speed reduction processing".

In step 20-13, the main CPU 40 counts the time during which the "speed reduction processing" is executed.

In step 20-14, the main CPU 40 decides whether the time which is counted by step 20-13 exceeds the predetermined time or not. Further, the main CPU 40 repeats this processing when the counted time does not exceed the predetermined time and advances to step 20-15 when the counted time exceeds the predetermined time.

Following the above-mentioned processing of step 20, in step 21, the main CPU 40 decides whether all reels 3L, 3C, 3R are stopped or not. Further, the main CPU 40 executes the processing of step 22 when all reels are stopped and executes the processing of step 16 when all reels are not stopped.

In step 22, the main CPU 40 transmits an all-reel stop command to a sub control circuit 72.

In step 23, the main CPU 40 executes the prize-winning retrieval processing. In this prize-winning retrieval processing, the agreement between the types of combination of the symbols which are actually lined up on the effective pay line and the inner lottery combinations which are decided by the probability lottery processing is checked.

In step 24, the main CPU decides whether the prize-winning flag is normal or not. Further, the main CPU executes the processing of step 26 when the prize-winning flag is normal and displays an illegal error at a predetermined position (step 25) when the prize-winning flag is not normal.

In step 26, the main CPU 40 executes storing or payout processing of the play medal corresponding to the winning combination.

In step 27, the main CPU 40 decides whether the currently advancing game state is the "general play state in BB" or the "RB play state" or not.

Here, "BB (Big Bonus)" or "RB (Regular Bonus)" means the inner winning combination to advance to a special play state which is an advantageous play state for a player.

Further, the main CPU 40 executes the processing of step 28 when the currently advancing play state is the "general play state in BB" or the "RB play state" and returns to step 2 when the currently advancing play state is not the "general play state in BB" or the "RB play state".

In step 28, the main CPU 40 executes game number check processing of the BB or RB play number.

In step 29, the main CPU 40 decides whether the currently advancing play state is at the time when the BB or RB game is finished or not. Further, the main CPU 40 executes the processing of step 30 when the present play state is at the time when the BB or RB game is finished and is returned to the processing of step 2 when the present play state is at the time when the BB or RB game is not finished.

In step 30, the main CPU executes the finishing time processing of BB or RB game and returns to the processing of step 2.

(Operation and Effect According to Motor Stop Control Device)

According to the present invention having such a constitution related to the present application, when the speed reduction transmission mechanism 700 transmits the rotation of the stepping motor 70 to the rotary shaft which rotates the reel 3 at the predetermined speed reduction ratio and the command for stopping the stepping motor 70 is generated in response to the command from the outside, the main CPU 40 selects either one of the reel stop control processing 1 which executes the stop control based on the all-phase excitation with respect to the stepping motor 70 and the reel stop control processing 2 which executes the control to reduce the rotational speed of the stepping motor 70 and executes the stop control based on the two-phase excitation with respect to the stepping motor 70 and hence, the motor stop control device can accurately stop the reel 3 at the target position and, at the same time, can offer a wide variety of stop processing of the reel 3.

Further, since the speed reduction transmission mechanism 700 transmits the rotation of the motor to the rotary shaft which rotates the reel 3 at the predetermined speed reduction ratio, the motor stop control device can suppress a stop error attributed to a detent torque generated at the time of stopping the reel to a low value. That is, when the speed reduction ratio is 1:7, the motor stop control device can suppress the degree of influence attributed to the detent torque to one seventh and can suppress the stop error attributed to the detent torque at the time of stopping the reel to a low value correspondingly.

Further, when the main CPU 40 selects the reel stop control processing 2 which executes the control to reduce the rotational speed of the stepping motor 70 and executes the stop control based on the two-phase excitation with respect to the stepping motor 70, the motor stop control device can readily attenuate the vibration of the reel which is generated at the time of stopping the reel.

Further, the main CPU 40 selects the reel stop control processing 1 when the decided number of slid frames is not within the range of the predetermined symbol number and selects the reel stop control processing 2 when the decided number of slid frames is within the range of the predetermined symbol number and hence, the motor stop control device can complete the stop processing of the reel 3 within the time which satisfies the regulations and, at the same time, it is possible to accurately stop the reel 3 at the target position.

That is, when the reel stop control processing 2 is selected when the above-mentioned number of slid frames exceeds the preset predetermined symbol number, since the processing to reduce the rotational speed of the reel 3 (speed reduction processing) is included to the reel stop control processing 2, there sometimes is an occasion that the stop processing of the reel 3 is not completed within the time which satisfies the regulations. Therefore, the reel stop control processing 1 which does not include the speed reduction processing is configured to be selected when the number of slid frames exceeds the preset predetermined symbol number and the reel stop control processing 2 which includes the speed reduction processing is configured to be selected when the number of slid frames does not exceed the predetermined symbol number and hence, the motor stop control device can complete the stop processing of the reel 3 within the time which satisfies the regulations and, at the same time, it is possible to stop the reel 3 accurately at the target position.

Further, since the reel stop control processing 1 is selected when the number of slid frames exceeds the preset predetermined symbol number, it appears to the player that the symbol is gently and slowly stopped. On the other hand, since the reel stop control processing 2 is selected when the number of slid frames does not exceed the preset predetermined symbol number, it appears to the player that the symbol is quickly stopped. Accordingly, the motor stop control device can offer a wide variety of stop processing of the reel 3 from a point of time that the reel 3 is rotated at a fixed speed to a point of time that the reel 3 is completely stopped and hence, the fun of the game can be further enhanced.

Further, the main CPU 40 selects either one of the reel stop control processing 1 or the reel stop control processing 2 corresponding to the decided winning combination, the motor stop control device can offer a wide variety of stop processing of the reel 3 and interest of the fun of the game can be further enhanced.

Further, the present invention is not limited to the reel stop control processing 1 and the reel stop control processing 2 and the following reel stop control processing 3, 4 may be adopted. That is, the reel stop control processing 3 executes the control in which the rotational speed of the stepping motor 70 is reduced from the time when a command for stopping the stepping motor 70 is generated in response to the command from the outside until the predetermined time passes and executes the stop control by the two-phase excitation with respect to the stepping motor 70. On the other hand, the reel stop control processing 4 executes the control in which the rotational speed of the stepping motor 70 is reduced from the time when a command for stopping the stepping motor 70 is generated in response to the command from the outside until the time shorter than the predetermined time passes and executes the stop control by the two-phase excitation with respect to the stepping motor 70.

Further, there may be more than three types of the reel stop control processing.

What is claimed is:

1. A motor stop control device for a gaming machine comprising:

a motor which constitutes a drive source of a reel which is stopped in response to a manipulation command and displays a plurality of symbols;

a speed reduction transmission mechanism which transmits a rotation of the motor to a rotary shaft, the rotary shaft rotating the reel at a predetermined speed reduction ratio; and a motor stop controller which, when a command for stopping the motor is generated in response to the command, selects either one of a first processing which executes a stop control with respect to the motor and a second processing which executes a control to reduce a rotational speed of the motor and executes the stop control with respect to the motor, wherein the motor has two pairs of excitation phases as the drive source of the reel, and the first processing executes the stop control based on all-phase excitation with respect to the motor and the second processing which executes the stop control based on two-phase excitation with respect to the motor.

2. A gaming machine comprising:

a motor which constitutes a drive source of a reel which is stopped in response to a manipulation command and displays a plurality of symbols;

a speed reduction transmission mechanism which transmits a rotation of the motor to a rotary shaft, the rotary shaft rotating the reel at a predetermined speed reduction ratio; and a motor stop controller which, when a command for stopping the motor is generated in response to the command, selects either one of a first processing which executes a stop control with respect to the motor and a second processing which executes a control to reduce a rotational speed of the motor and executes the stop control with respect to the motor, wherein the motor has two pair of excitation phases as the drive source of the reel, and the first processing executes the stop control based on all-phase excitation with respect to the motor and the second processing which executes the stop control based on two-phase excitation with respect to the motor.

3. A gaming machine comprises:

a motor which constitutes a drive source of a reel which is stopped in response to a manipulation command and displays a plurality of symbols;

a speed reduction transmission mechanism which transmits a rotation of the motor to a rotary shaft, the rotary shaft rotating the reel at a predetermined speed reduction ratio; and a motor stop controller which, when a command for stopping the motor is generated in response to the command, selects either one of a first processing which executes a stop control with respect to the motor and a second processing which executes a control to reduce a rotational speed of the motor and executes the stop control with respect to the motor, wherein the motor stop controller selects the first processing when a traveling of the symbols displayed on the reel which is determined by computer does not fall within a predetermined range of number of the symbols at the time of generation of a command to stop the motor, and selects the second processing when the traveling determined by the computer falls within a predetermined range of number of symbols.

4. A gaming machine comprises:

a motor which constitutes a drive source of a reel which is stopped in response to a manipulation command and displays a plurality of symbols;

a speed reduction transmission mechanism which transmits a rotation of the motor to a rotary shaft, the rotary shaft rotating the reel at a predetermined speed reduction ratio; and a motor stop controller which, when a command for stopping the motor is generated in response to the command, selects either one of a first processing which executes a stop control with respect to the motor and a second processing which executes a control to reduce a rotational speed of the motor and executes the stop control with respect to the motor, further comprising a computer for determining a winning combination, wherein the motor stop controller selects either one of the first processing and the second processing corresponding to the winning combination.

* * * * *